US011259986B1

(12) United States Patent
Kondrukevich et al.

(10) Patent No.: US 11,259,986 B1
(45) **Date of Patent: *Mar. 1, 2022**

(54) REDUCED FRICTION MASSAGE SURFACES AND EXERCISE EQUIPMENT

(71) Applicants: Aleksandr Kondrukevich, Brooklyn, NY (US); Maksim Kondrukevich, Staten Island, NY (US)

(72) Inventors: Aleksandr Kondrukevich, Brooklyn, NY (US); Maksim Kondrukevich, Staten Island, NY (US)

( * ) Notice: Subject to any disclaimer, the term of this patent is extended or adjusted under 35 U.S.C. 154(b) by 815 days.

This patent is subject to a terminal disclaimer.

(21) Appl. No.: 15/979,929

(22) Filed: May 15, 2018

Related U.S. Application Data

(63) Continuation-in-part of application No. 15/601,010, filed on May 22, 2017, now Pat. No. 10,780,010.

(51) Int. Cl.
*A61H 1/02* (2006.01)
*A61H 15/00* (2006.01)
(Continued)

(52) U.S. Cl.
CPC ..... *A61H 15/00* (2013.01); *A61H 1/0218* (2013.01); *A63B 21/0628* (2015.10); *A63B 21/072* (2013.01); *A63B 21/154* (2013.01); *A63B 21/4011* (2015.10); *A63B 21/4019* (2015.10); *A63B 21/4031* (2015.10); *A63B 23/0238* (2013.01); *A61H 2015/0042* (2013.01); *A61H 2015/0064* (2013.01); *A61H 2201/0192* (2013.01); *A61H 2201/1261* (2013.01); *A61H 2201/169* (2013.01); *A61H 2201/1623* (2013.01); *A61H 2201/1638* (2013.01); *A61H 2201/1642* (2013.01); *A61H 2203/0406* (2013.01); *A61H 2203/0456* (2013.01);
(Continued)

(58) Field of Classification Search
CPC ..... A63B 21/062–0628; A63B 21/15; A63B 21/00178; A63B 23/0238; A63B 22/205; A63B 2208/0252; A61H 2203/0456; A61H 1/0218; A61H 1/0222; A61H 1/0229
See application file for complete search history.

(56) References Cited

U.S. PATENT DOCUMENTS 2,674,996 A * 4/1954 Stowell ..... A61H 1/0218 602/36
4,648,594 A * 3/1987 Schleffendorf .... A63B 21/0609 482/102
(Continued)

*Primary Examiner* — Michael J Tsai
(74) *Attorney, Agent, or Firm* — Lawrence G. Fridman, ESQ; Feigin & Fridman, LLC

(57) ABSTRACT

A reduced friction massage and exercise device, which includes a base frame and at least one anchoring arrangement for anchoring a first body part of a user. A reduced friction surface is mounted onto the base frame, and includes a plurality of ball transfer units arranged such that adjacent ball transfer units engage one another. The device further includes at least one cable column including a weight stack. Each of the motion transfer balls is adapted for omnidirectional rotation relative to a corresponding housing element and independently of other the motion transfer balls. The reduced friction surface is adapted to have a second body part of the user placed thereon during performing of a physical activity applying force to the second body part, while reducing friction between the second body part and the surface.

18 Claims, 32 Drawing Sheets

(51) Int. Cl.

| | |
|---|---|
| ***A63B 21/062*** | (2006.01) |
| ***A63B 23/02*** | (2006.01) |
| ***A63B 21/00*** | (2006.01) |
| ***A63B 21/072*** | (2006.01) |
| *A63B 23/00* | (2006.01) |

(52) U.S. Cl.
CPC .. *A61H 2205/081* (2013.01); *A63B 2023/006* (2013.01); *A63B 2225/093* (2013.01)

(56) References Cited

U.S. PATENT DOCUMENTS

| | | | | |
|---|---|---|---|---|
| 4,867,142 | A * | 9/1989 | Jones | A61H 1/0229 601/115 |
| 6,245,000 | B1 * | 6/2001 | Saakian | A61H 15/00 482/142 |
| 6,569,069 | B1 * | 5/2003 | Linares | A61H 1/0292 482/140 |
| 6,843,759 | B2 * | 1/2005 | Wallerstein | A63B 21/4009 482/140 |
| 6,939,272 | B1 * | 9/2005 | Wu | A63B 21/153 482/100 |
| 10,780,010 | B2 * | 9/2020 | Kondrukevich | A61H 15/00 |
| 2002/0099312 | A1 * | 7/2002 | Smith | A61H 15/00 601/131 |
| 2005/0197602 | A1 * | 9/2005 | Kwen | A61H 7/001 601/131 |
| 2012/0253248 | A1 * | 10/2012 | Carlson | A61H 15/00 601/128 |
| 2017/0056283 | A1 * | 3/2017 | Baumann | A61H 15/00 |

* cited by examiner

REDUCED FRICTION MASSAGE SURFACES AND EXERCISE EQUIPMENT

REFERENCE TO RELATED APPLICATION

This Application is a continuation-in-part Application of application Ser. No. 15/601,010 filed May 22, 2017, the entire disclosure of which is hereby incorporated by reference.

FIELD AND BACKGROUND OF THE DISCLOSED TECHNOLOGY

The disclosed technology relates generally to reduced friction massage surfaces and exercise equipment, and, more specifically to massage surfaces and exercise equipment formed utilizing multiple ball transfer units, to and methods of use thereof.

As known, a healthy spine is formed of bony vertebrae, which are interconnected by intervertebral joints and are held together by intervertebral ligaments. Between the vertebrae are disposed intervertebral discs formed of a fibrous tissue, which perform a damping function. The spine is retained in a normal state by a muscular framework supporting the vertebrae, joints, ligaments, and discs.

With age, for natural reasons as well as due to increased loads and a variety of other reasons, the muscular framework supporting the spine weakens. Consequently, the load on the intervertebral joints increases, and the mobility of the intervertebral joints and of the spine in general is impaired. Additionally, the intervertebral discs often become thinner and their damping function may deteriorate or be lost. As a result, the load on the vertebrae increases, causing the spine to compress and shorten. The damage to the spine and spinal cord and impaired movement of the spine and body, may result in various types of muscular dysfunction and/or dysfunction of the internal organs.

Decompression or stretching of the spine, as achieved, for example, by use of massage and massage surfaces, removes some of the load from the spine and helps improve or restore the function of the spinal cord. Consequently, stretching of the spine may also improve or restore muscular mobility and may strengthen the muscular framework supporting the spine. As such, decompression of the spine may be the start of a process of normalizing the function of the spine and restoring disturbed functions of the human body.

Stretching of the spine over a massage surface, requires motion of the body over the surface. As is well known in the laws of physics, a frictional force exists between a moving object and a surface on which the object is moving. As such, in order to move an object lying on a surface, one must overcome the frictional force by making an effort, or apply a force, greater than the frictional force. As the frictional force decreases, the force required to move the object also decreases.

Many different methods and devices have been proposed for reducing the frictional force between a moving object and a surface on which the object is moving. Some such methods and devices make use of balls to reduce the friction.

U.S. Pat. No. 5,096,308 to Sundseth is directed to ball units including a load-bearing ball seated in an essentially radially symmetric bearing units having ball bearings in a bearing shell. The load-bearing ball is held in the bearing unit by a securing apparatus. The bearing unit has a supporting structure that enables the bearing unit to be fixed in an opening of a carrier plate in such a way that it can support a load. Detents are provided to lock the unit in the opening against the load direction.

U.S. Pat. No. 3,466,697 relates to a spring-loaded ball transfer or caster unit, which includes means for releasably securing the ball unit to structures with which the ball unit is associated, and/or means serving to limit movement of the ball responsive to a load applied to the ball. Such ball transfer units are usable in a pallet or platform for moving a container or box, as on a conveyer belt.

Additionally, many people try to restore normal function of the muscles and skeleton by exercise and increasing physical activity. However, most sport equipment available for use, for example in gyms and parks, is designed in such a way that the development of the muscles is associated with active compression of the joints and spine. As such, use of these types of exercise machines does not provide the desired decompression of the spine and joints, and may in fact cause injuries or exacerbate the existing problems.

However, there is a need in the art for massage surfaces and exercise equipment which reduce the friction between the surface and the body of the user, to allow for easy and effective stretching of the person's spine during the massage and/or exercise.

SUMMARY OF THE DISCLOSED TECHNOLOGY

The disclosed technology relates generally to massage surfaces and exercise equipment, and, more specifically to massage surfaces and exercise equipment formed utilizing multiple ball transfer units.

In accordance with an aspect of one embodiment of the present invention, there is provided a reduced friction massage and exercise device, the device including:

a base frame;

at least one anchoring arrangement for anchoring a first body part of a user;

a reduced friction surface mounted onto the base frame, the reduced friction surface including a plurality of ball transfer units each including a housing element housing a motion transfer ball, the plurality of ball transfers units arranged such that adjacent ones of the plurality of ball transfer units engage one another; and at least one cable column including a weight stack;

wherein each of the motion transfer balls is adapted for omnidirectional rotation relative to a corresponding housing element and independently of other the motion transfer balls, wherein the reduced friction surface is adapted to have a second body part of the user placed thereon during performing of a physical activity applying force to the second body part, while reducing friction between the second body part and the surface.

In some embodiments, the anchoring arrangement is movable relative to the reduced friction surface, so as to adjust a distance between the anchoring arrangement and the reduced friction surface to be suited to dimensions of the user.

In some embodiments, the at least one cable column includes at least one guiding cable functionally associated with the weight stack, the at least one guiding cable being adapted to be connected to a body part of the user when the user performs the physical activity so as to apply additional load to the second body part during the physical activity.

In some embodiments, the base frame, the at least one anchoring arrangement, and the reduced friction surface are moveable relative to the cable column.

In some embodiments, the at least one anchoring arrangement and the reduced friction surface are movable relative to the base frame, so as to change the angular inclination of the reduced friction surface relative to the horizon.

In some embodiments, the at least one anchoring arrangement includes an anchoring arrangement for anchoring hands of the user, and wherein the reduced friction surface is adapted to be inclined relative to the base frame, such that a head of the user is disposed higher than legs of the user during the physical activity. In some such embodiments, the reduced friction surface is convex along a longitudinal direction thereof.

In some embodiments, the at least one anchoring arrangement includes an anchoring arrangement for anchoring legs of the user, and wherein the reduced friction surface is adapted to be inclined relative to the base frame, such that a head of the user is disposed lower than legs of the user during the physical activity. In some such embodiments, the reduced friction surface is planar.

In some embodiments, the reduced friction surface is barrel shaped and is in a fixed position relative to the base frame. In some embodiments, the at least one cable column includes a first cable column and a second cable column, the first and second cable columns having guiding cables enabling the user to manipulate the weight stacks of the first and second cable columns, the guiding cables being arranged at an angle relative to each other when the user is not engaging the guiding cables.

In such some embodiments, the at least one anchoring element includes an anchoring rack including a plurality of crossbeams, the anchoring rack having a curved profile, wherein a curvature of the curved profile corresponds to a curvature of the barrel shaped reduced friction surface.

In accordance with another aspect of one embodiment of the present invention, there is provided a method of exercising using the reduced friction device described herein, the method including:

disposing the second body part of the user on the reduced friction surface;

engaging the at least one anchoring element at least with the first body part of the user; and carrying out a physical activity while the second body part of the user is disposed on the reduced friction surface.

Regardless of the relative locations of frame and massage surface assembly, the angle of inclination of massage surface, and the load applied or not applied by cable column, the ball transfer units of massage surface provide acupressure to parts of the user's body leaning on or in contact with massage surface during the exercise and contribute to more complete stretching of the muscles, and correspondingly to more significant decompression of the user's spine and joints.

In some embodiments, the carrying out of a physical activity includes allowing the second body part of the user to be pulled along the reduced friction surface under gravitational pull, so as to stretch muscles of the second body part of the user and to decompress bones and joints associated with the muscles.

In some embodiments, the carrying out a physical activity includes carrying out the physical activity using the second body part of the user or a third body part of the user adjacent to the second body part of the user, and the user's own body weight.

In some embodiments, the method further includes:

setting the weight stack of the at least one cable column to a weight suitable for exercise by the user; and attaching a guiding cable of the at least one cable column to the second body part of user or to a third body part of the user adjacent the second body part of the user, and wherein the carrying out a physical activity includes carrying out the physical activity using the second body part of the user or the third body part of the user using load applied by the weight stack.

In some embodiments, the attaching a guiding cable includes attaching a first guiding cable of a first of the at least one cable column to the second body part of the user and attaching a second guiding cable of a second of the at least one cable column to the third body part of the user, wherein the carrying out physical activity includes carrying out physical activity using the third body part of the user using the load applied by the weight stack of the second cable column, and wherein the weight stack of the first cable column is used to anchor the second body portion of the user.

In some embodiments, the method further includes prior to disposing the second body part on the reduced friction surface, adjusting a position of the base frame and the reduced friction surface relative to the weight stack.

In some embodiments, the method further includes, adjusting an angular inclination of the reduced friction surface relative to the base frame.

In some embodiments, the method further includes, prior to the anchoring, adjusting a distance between the at least one anchoring element and the reduced friction surface to be suited to dimensions of the user.

DETAILED DESCRIPTION OF EMBODIMENTS OF THE DISCLOSED TECHNOLOGY

Figure 1A:
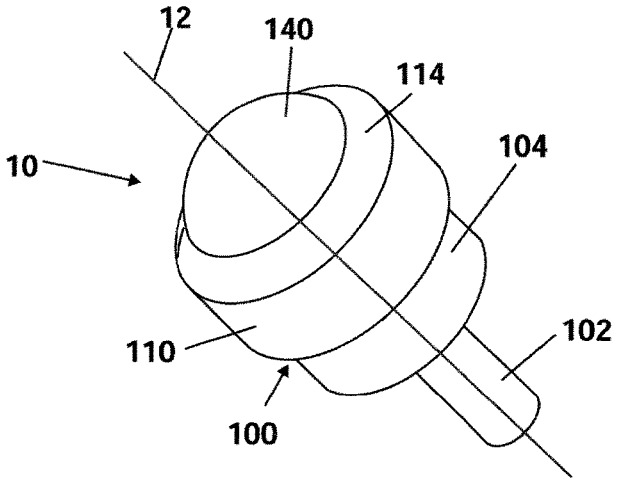
FIGS. 1A, 1B, 1C, 1D, and 1E are, respectively, a perspective view illustration, a top plan view illustration, a side plan view illustration, a bottom plan view illustration, and a sectional illustration, of a ball transfer unit according to an embodiment of the disclosed technology.
Figure 1B:
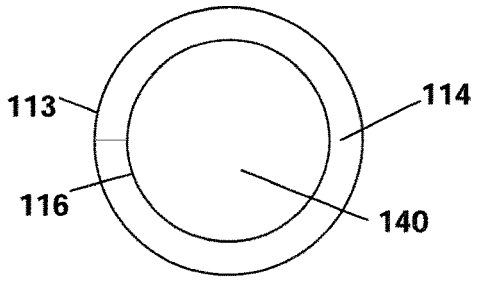
Figure 1C:
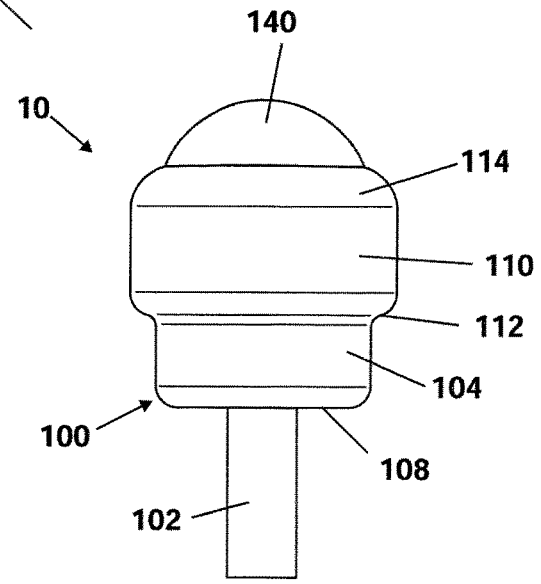
Figure 1E:
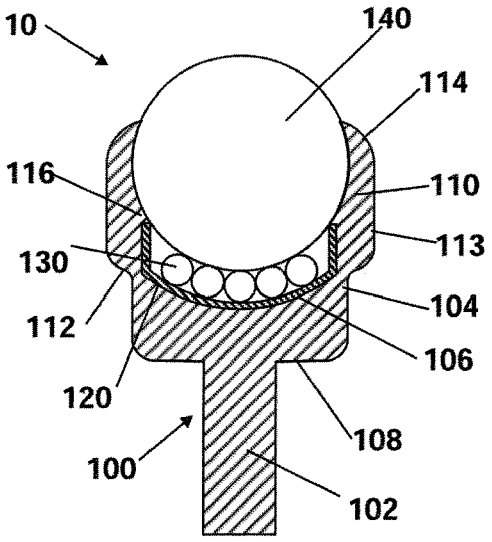
Figure 1D:
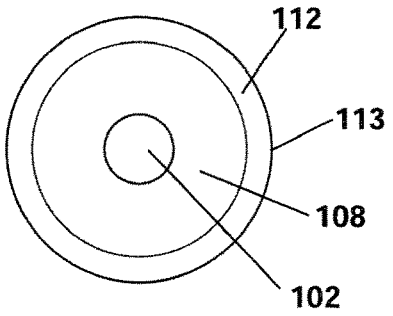

In an embodiment of the disclosed technology, a plurality of ball transfer units are used together to form a reduced friction surface. The reduced friction surface lies on a base and is particularly useful for carrying out a physical activity on, or applying force to, a body part on the surface. For example, the body part may be massaged while on the reduced friction surface or may be stretched so as to decompress the spine. Carrying out the physical activity on the reduced friction surface is particularly advantageous in that little friction is present thereby allowing for movement while applying less force, and the mass of the body part is distributed on the ball transfer units, and is spread out thereby, which is advantageous when stretching muscles or decompressing the spine.

Embodiments of the disclosed technology will become clearer in view of the following description of the drawings.

Reference is now made to FIGS. 1A, 1B, 1C, 1D, and 1E, which are, respectively, a perspective view illustration, a top plan view illustration, a side plan view illustration, a bottom plan view illustration, and a sectional illustration, of a ball transfer unit according to an embodiment of the disclosed technology.

As seen, a ball transfer unit 10 is arranged about a longitudinal axis 12, and, in some embodiments, is symmetrical with respect to the longitudinal axis. Ball transfer unit 10 includes a housing element 100 formed with an elongate stem 102 arranged along the longitudinal axis 12. The stem 102 is terminated at an upper end thereof, in a base portion 104. In some embodiments, such as the illustrated embodiments, the stem 102 is generally cylindrical. It should be noted, however that the ball transfer units formed without elongate stems also form a part of the invention.

The base portion 104 extends from stem 102 to a concave upper surface 106, which, in some embodiments, may have a circular cross section. Typically, a diameter of the base portion 104 is significantly greater than a diameter of stem 102, such that an annular shoulder 108 forms where stem 102 is connected to the lower surface of base portion 104. This is particularly important in order to arrange, or pack, the ball transfer units very close to one another, as described in further detail hereinbelow. For example, a ratio between the diameter of stem 102 and the diameter of base portion 104 may be at most 1:2, at most 1:3, or at most 1:4. The specific ration between the diameter of stem 102 and the diameter of base portion 104 affects the overall weight of the housing element 100. Extending upwardly from base portion 104, about concave upper surface 106, is a cylindrical portion 110, having a diameter equal to, or slightly greater than the diameter of base portion 104, such that an annular shoulder 112 forms where base portion 104 is connected to the cylindrical portion 110. In some embodiments, such as the illustrated embodiment, the shoulder 112 may be slanted relative to the longitudinal axis 12. Cylindrical portion 110 includes an outer wall 113, which terminates, at an upper end thereof, in a lip 114, which may be inwardly curved or slanted relative to the longitudinal axis 12. Concave upper surface 106, together with inner wall 116 of cylindrical portion 110, form a hollow cup.

A coating 120 is disposed within the hollow cup on concave upper surface 106, and, in some embodiments, on a lower portion of inner wall 116. The coating 120 must be smooth so as to allow ball bearing engaged therewith to roll on the coating 120. In some embodiments, the coating 120 may be formed of a material having a low friction coefficient, such as metal, plastic, wood, glass, bone, or a combination thereof. In some embodiments, the hardness of the coating should be equal to or greater than the hardness of the material from which the ball bearings are formed, to avoid deformation of the coating during use.

A plurality of ball bearings 130 are disposed within the hollow cup and engage the coating 120 at concave upper surface 106. A motion transfer ball 140 is placed within the hollow cup above ball bearings 130 and rests thereon, without engaging inner wall 116 of cylindrical portion 110. At least a portion of the motion transfer ball 140 extends out of the housing element 100, above lip 114. Motion transfer ball 140 is free to rotate in any direction (omnidirectional rotation) relative to the hollow cup, with substantially no friction, due to its rolling on ball bearings 130 which engage and roll over coating 120.

In some embodiments, concavity of inner wall 116 also ensures that motion transfer ball 140 cannot "pop out" of the housing element 100. In some embodiments, the motion transfer ball 140 is formed of at least one of metal, plastic, wood, glass, bone, or a combination thereof.

In some embodiments, a diameter of the motion transfer ball 140 is commensurable with the size of the vertebral discs and intervertebral distances. In some embodiments, the diameter of the motion transfer ball 140 is within the range of 15 mm to 40 mm. In some embodiments, a diameter of each ball bearing 130 is within the range of 2 mm to 6 mm. In some embodiments, a ratio between the diameter of each ball bearing 130 and the diameter of motion transfer ball 140 is in the range of 1:5 to 1:20.

Figure 2A:
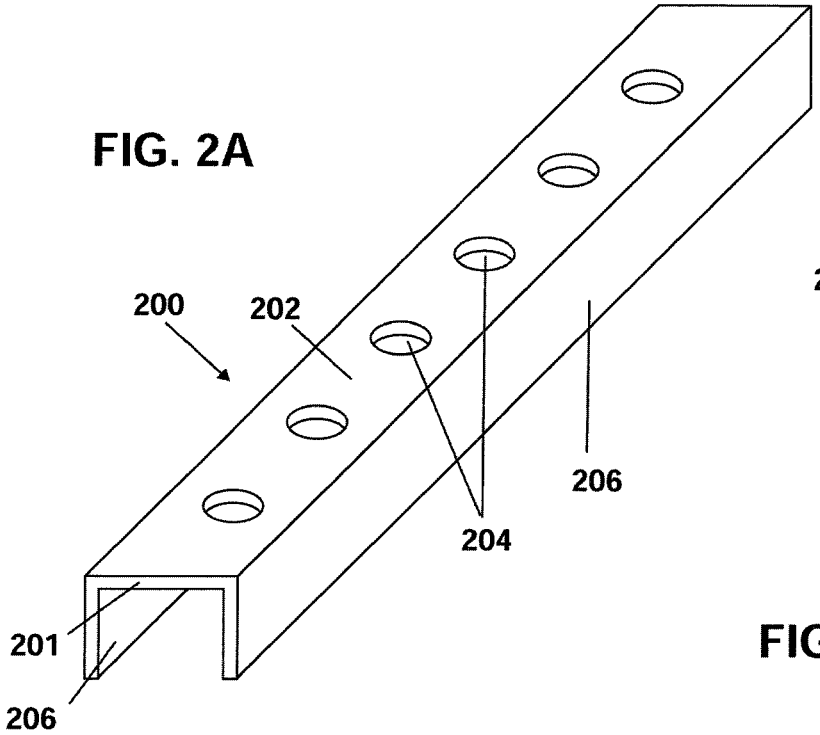
FIGS. 2A and 2B are, respectively, a perspective view illustration and a top plan view illustration of a bracket for housing a plurality of ball transfer units according to an embodiment of the disclosed technology.
Figure 2B:
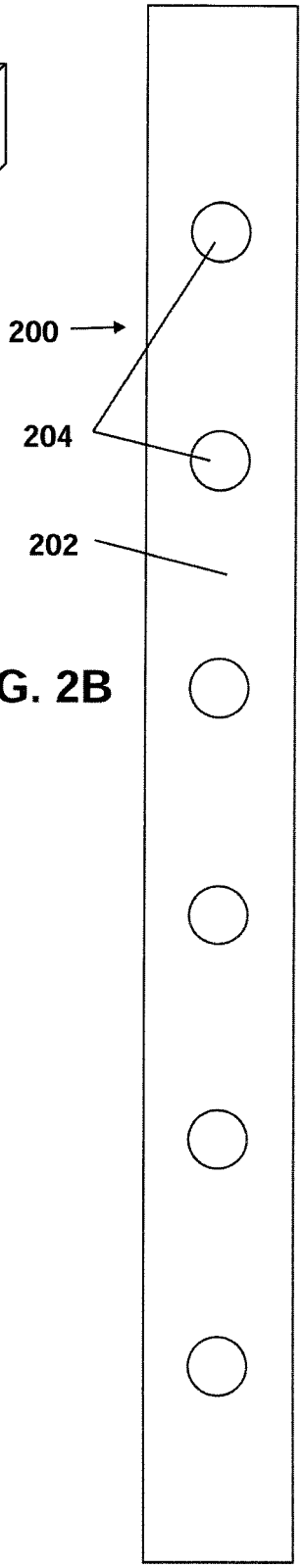

Reference is now made to FIGS. 2A and 2B, which are, respectively, a perspective view illustration and a top plan view illustration of a bracket suitable for housing a plurality of ball transfer units 10 according to an embodiment of the disclosed technology.

As seen in FIGS. 2A and 2B, a bracket 200 includes a receiving portion 201 defining an outer surface 202, the receiving portion 201 including a plurality of through-going receiving bores 204, and at least one support 206 which supports the bracket 200 when standing on a base surface. The receiving bores 204 are typically circular and have a circumference greater than the circumference of stem 102 (FIGS. 1A to 1E) and smaller than the circumference of base portion 104 of a ball transfer unit 10. In the embodiment where the ball transfer units are formed without elongate stems the receiving bores 204 are not required, and the ball transfer units 10 can be attached to the brackets by any conventional means.

In some embodiments, such as the embodiment illustrated in FIGS. 2A and 2B, the receiving bores 204 are arranged in a single line, and the receiving surface comprises an elongate strip. In other embodiments (not shown), the receiving bores 204 may be arranged in multiple lines, a matrix, a square, a rectangle, or any other suitable arrangement. The shape of the receiving portion 201 and of surface 202 is selected to accommodate the arrangement of the receiving bores 204. In some embodiments, the distance from one receiving bore 204 to a second, adjacent receiving bore 204, is fixed.

In the embodiment illustrated in FIG. 2A, the support 206 includes two support walls, extending from edges of the receiving portion 201 along an elongate side thereof. However, in other embodiments the support 206 may include four support walls extending from all four edges of the receiving portion, or any other configuration of support walls disposed along edges of the receiving portion. In some embodiments, the support 206 may include, in addition to support walls, a support base (not shown). In general, any suitable configuration of the support 206 is considered to be within the scope of the present invention, provided that the support 206 does not block the receiving bores 204 or interfere with the ability to accommodate stems 102 of ball transfer units 10 in the bores 204.

Reference is now made to FIGS. 3A, 3B, 3C, and 3D, which are, respectively, a perspective view illustration, a narrow side plan view illustration, a broad side plan view illustration, and a top plan view illustration of a ball transfer unit block 300 including bracket 200 of FIGS. 2A and 2B having housed therein a plurality of ball transfer units 10 of FIGS. 1A to 1E.

Figure 3B:
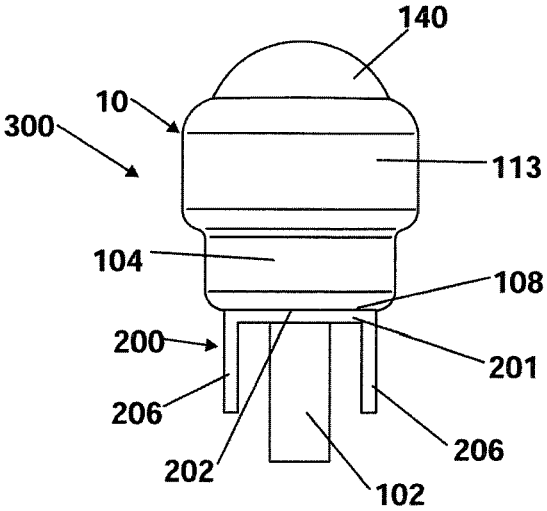
FIGS. 3A, 3B, 3C, and 3D are, respectively, a perspective view illustration, a narrow side plan view illustration, a broad side plan view illustration, and a top plan view illustration of a ball transfer unit block including the bracket of FIGS. 2A and 2B having housed therein ball transfer units of FIGS. 1A to 1E.
Figure 3A:
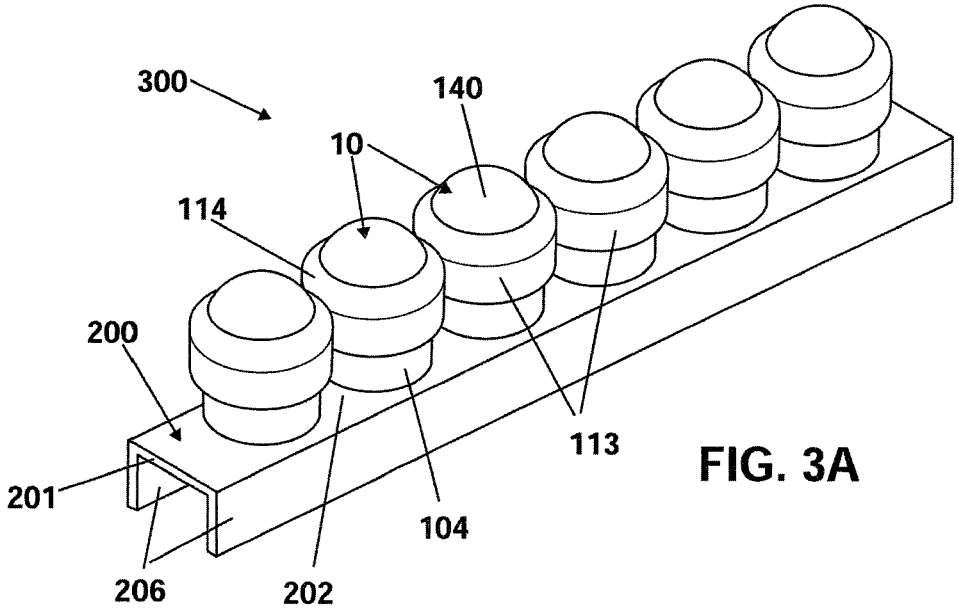

As seen in the Figures, ball transfer unit block 300 includes a plurality of ball transfer units 10 disposed in bracket 200 such that stems 102 are received within receiving bores 204. In some embodiments, annular shoulders 108 of ball transfer units 10 engage surface 202 of receiving portion 201, as seen in FIGS. 3A and 3B. In other embodiments, the stems 102 are supported such that annular shoulders 108 are disposed above, and are spaced from, the outer surface 202 of the receiving portion 201. Since the motion transfer balls 140 of the ball transfer units 10 do not engage one another, each motion transfer ball 140 is capable of omnidirectional rotation relative to the housing element and independently of other motion transfer balls in the block.

Figure 3C:
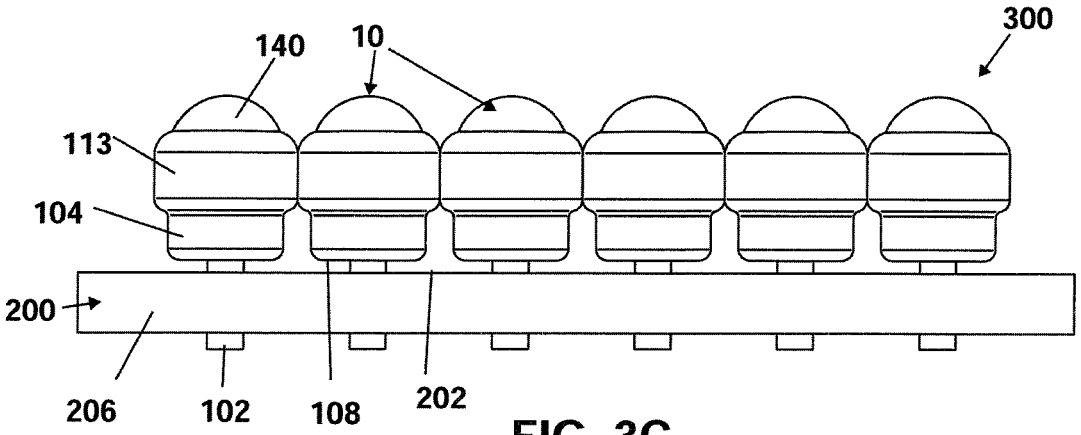
Figure 3D:
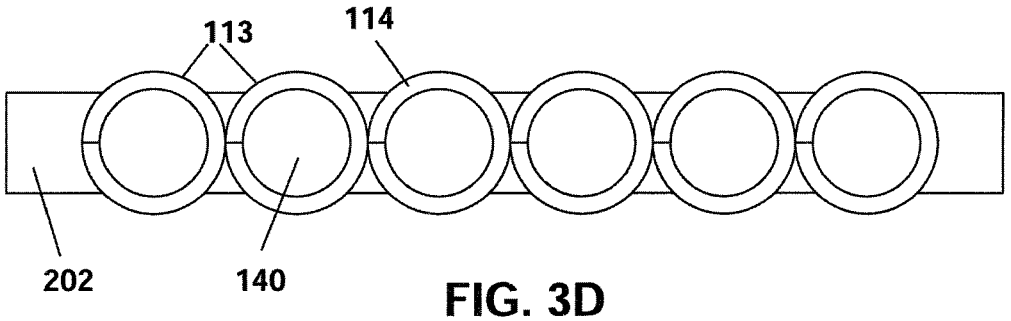

It is a particular feature of the present invention that the receiving bores 204 are spaced such that the outer walls 113 of adjacent ball transfer units 10 engage one another, as seen clearly in FIGS. 3C and 3D. Additionally, as seen clearly in FIG. 3C, all the ball transfer units 10 are at a uniform height, when disposed in bracket 200. This is particularly important for even load distribution on the ball transfer units, as explained in detail hereinbelow. Each ball transfer unit 10 is fixed to bracket 200 by means of a nut, welding, glue or other means suitable for fixing housing element 100 of the ball transfer unit 10 to the bracket without restricting the movement of the ball bearings 130 or motion transfer ball 140.

In some embodiments, all the motion transfer balls 140 in the block 300 are formed of the same material. In some embodiments, all the motion transfer balls 140 in the block 300 have the same diameter.

Figure 4:
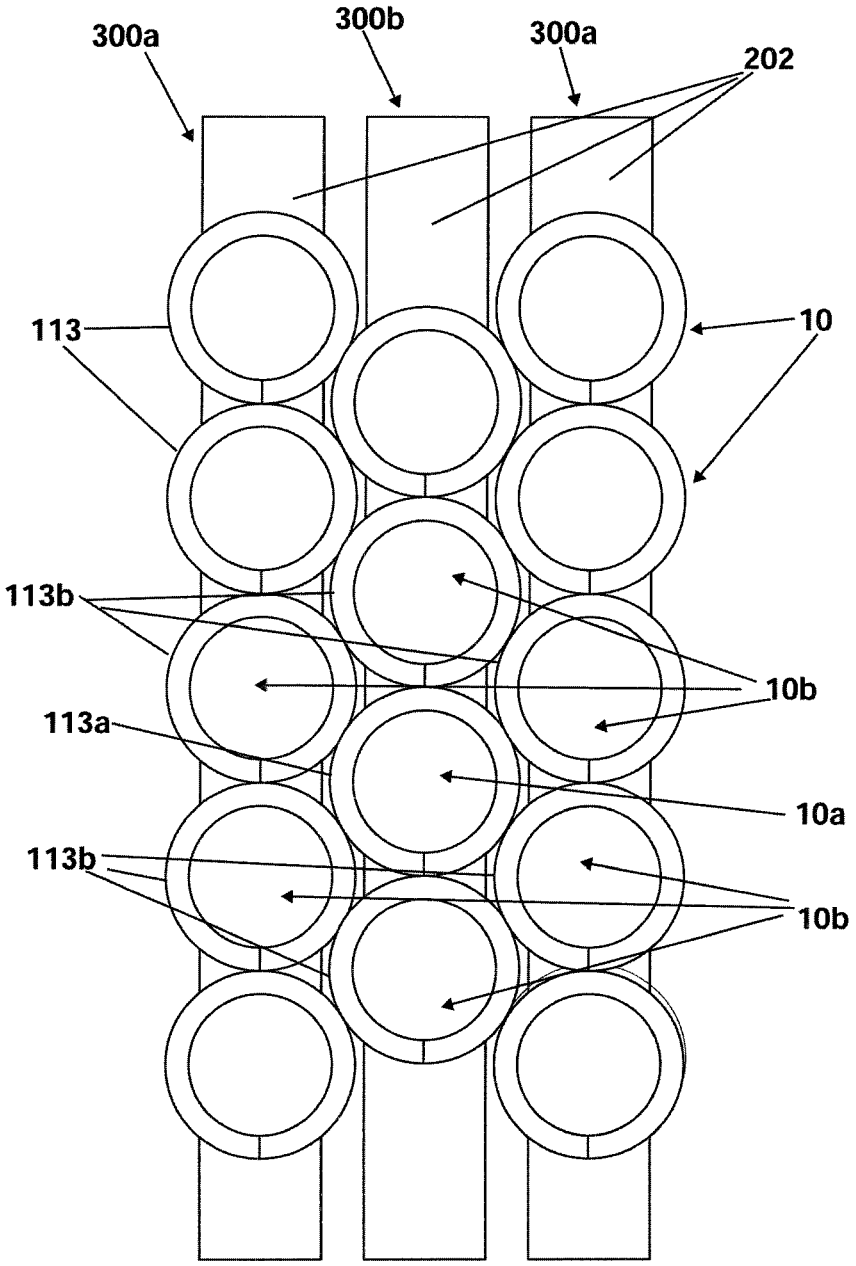
FIG. 4 is a top plan view illustration of a surface formed of a plurality of ball transfer unit blocks of FIGS. 3A to 3D according to an embodiment of the disclosed technology.

Reference is now made to FIG. 4, which is a top plan view illustration of a surface formed of a plurality of ball transfer unit blocks 300 of FIGS. 3A to 3D according to an embodiment of the disclosed technology.

As seen in FIG. 4, the brackets 200 of the ball transfer unit blocks 300 are arranged in parallel to one another and are sufficiently close to one another such that outer walls 113 of adjacent ball transfer units 10 engage one another.

In some embodiments, the ball transfer unit blocks 300 are arranged such that empty space between ball transfer units 10 will be minimized. In one such embodiment, illustrated in FIG. 4, the outer wall 113*a* of a specific ball transfer unit 10*a* engages outer walls 113*b* of six neighboring ball transfer units 10*b*, in a honeycomb like structure. In such embodiments, some of the ball transfer unit blocks 300 may have a greater number of ball transfer units than others. In the illustrated embodiment, ball transfer unit blocks 300*a* each include five ball transfer units, whereas ball transfer unit block 300*b* includes four ball transfer units.

Reference is now made to FIGS. 5A, 5B, 5C, and 5D, which are perspective view illustrations of a ball transfer unit block 300 mounted onto a base frame, according to four different embodiments of the present invention. As seen, in each of FIGS. 5A to 5D, a single ball transfer unit block 300 including a plurality of ball transfer units 10 is mounted onto a base frame 500 including two frame walls disposed in parallel to one another.

Figure 5A:
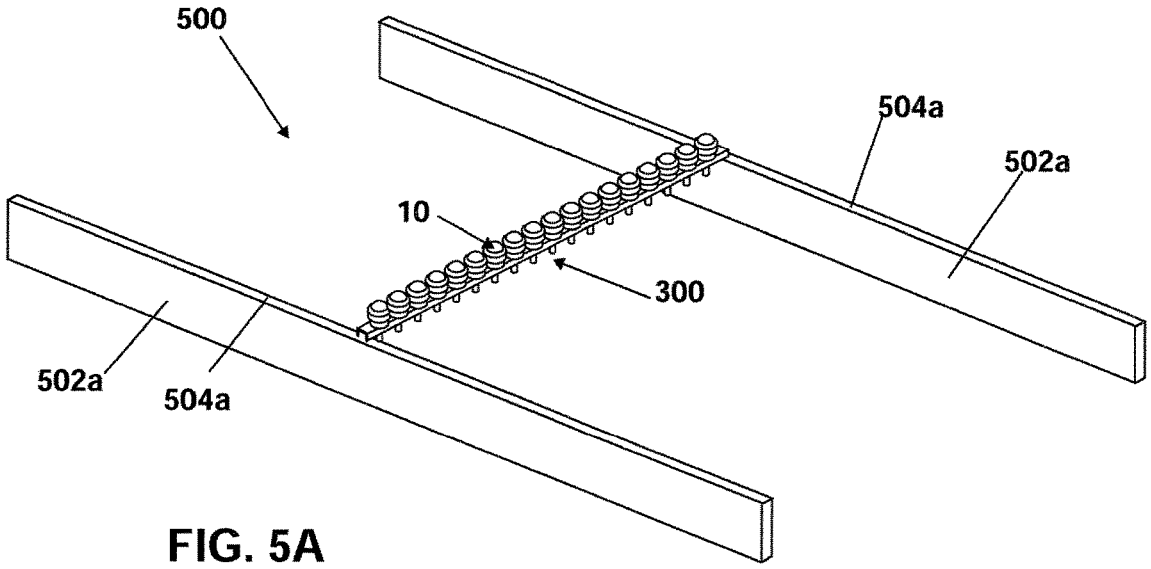
FIGS. 5A, 5B, 5C, and 5D are perspective view illustrations of the ball transfer unit block of FIGS. 3A to 3D mounted onto a base frame, according to four different embodiments of the present invention.
Figure 5B:
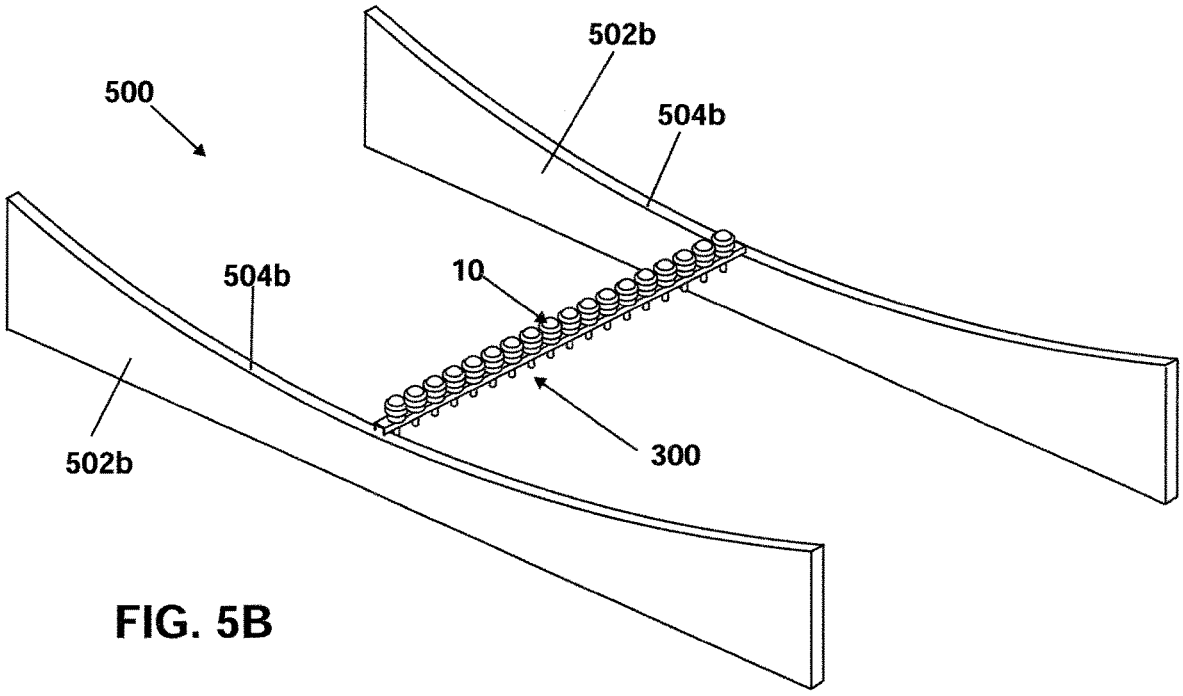
Figure 5C:
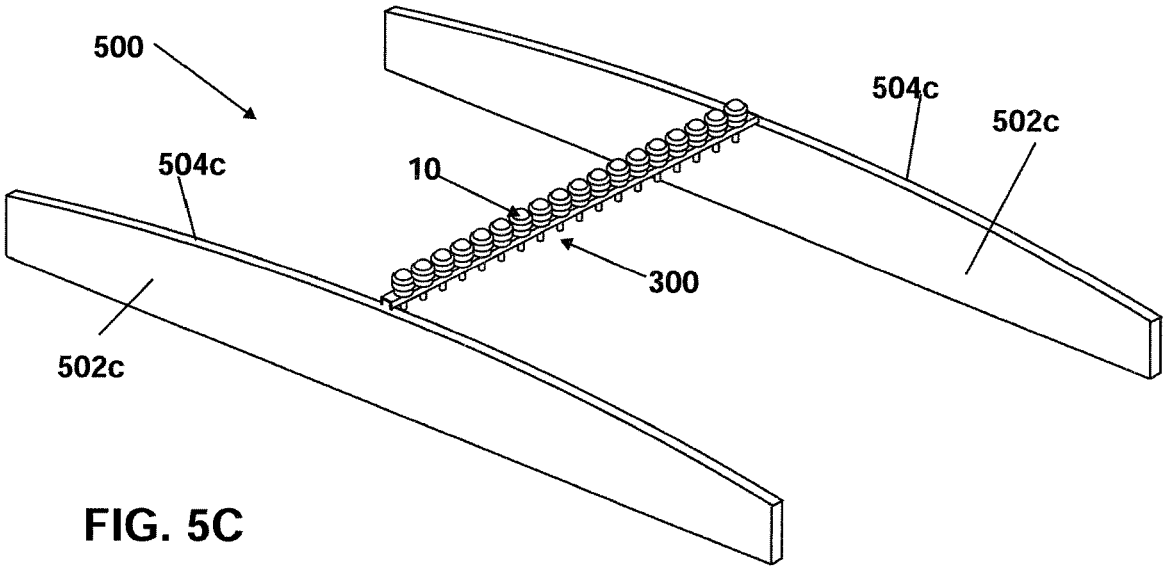
Figure 5D:
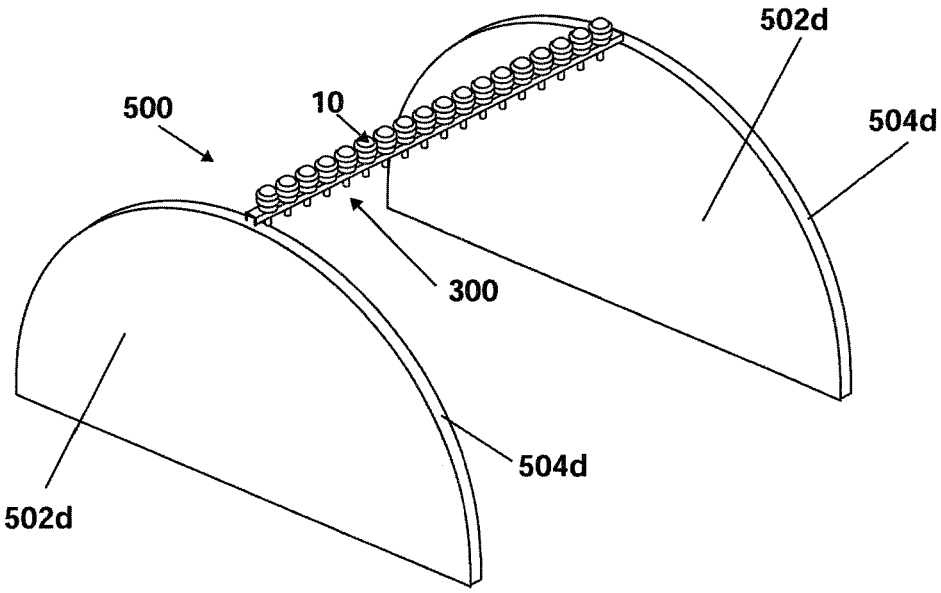

In the embodiment of FIG. 5A, frame walls 502*a* each have a flat, or horizontal, upper edge 504*a*. In the embodiment of FIG. 5B, frame walls 502*b* each have a concave upper edge 504*b*. In the embodiment of FIG. 5C, frame walls 502*c* each have a mildly convex upper edge 504*c*. In the embodiment of FIG. 5D, frame walls 502*d* are hemispherical, and as such define a convex or hemispherical edge 504*d*.

In all the illustrated embodiments, the ball transfer unit block 300 is placed at the center of the frame walls.

However, it is appreciated that the ball transfer unit block 300 may be disposed anywhere along the edge of the frame wall, regardless of the curvature, or lack thereof, of the edge of the frame wall.

The ball transfer unit block 300 may be connected to the frame walls by any suitable means. In some embodiments, the frame walls included dedicated tracks, and the bracket 200 of the ball transfer unit 300 may be seated in, or snap fit into, the dedicated tracks. In other embodiments, the bracket 200 of the ball transfer unit 300 may be disposed upon the edge of the frame wall, and may be secured thereto by any suitable means, such as adhesive, soldering, nuts and bolts, nails, and the like.

Figure 6A:
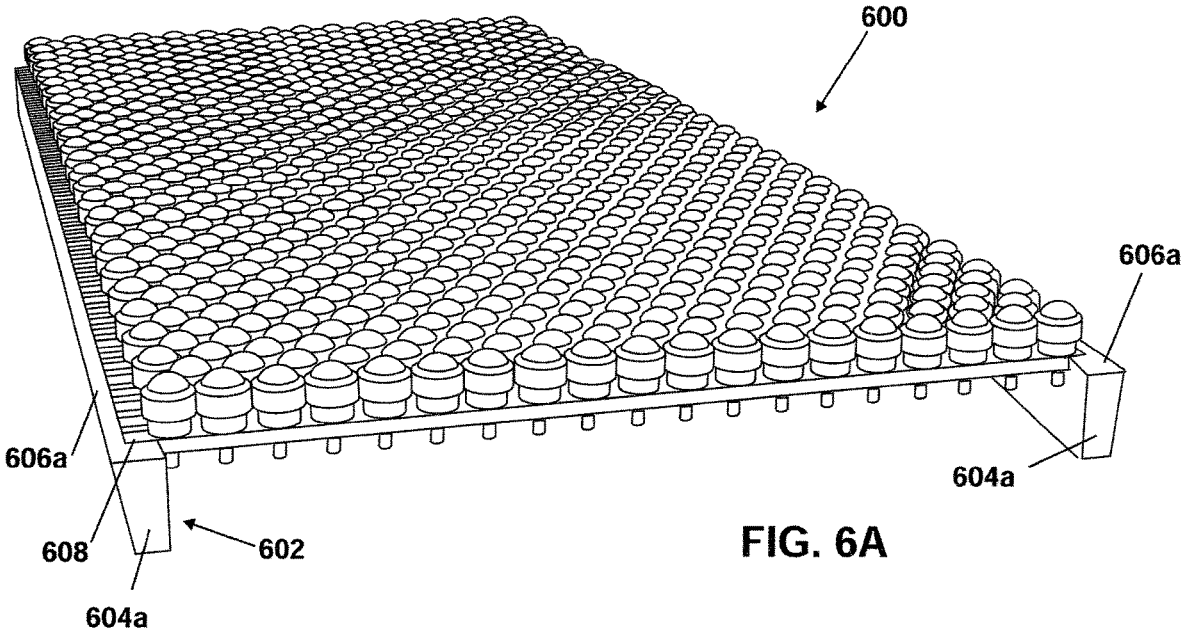
FIGS. 6A and 6B are perspective view illustrations of a flat massage surface formed of a plurality of ball transfer unit blocks of FIGS. 3A to 3D mounted onto a linear base frame, where in FIG. 6A the linear surface base the ball transfer unit blocks are disposed in a dedicated track within the base frame, and in FIG. 6B the ball transfer unit blocks are disposed above the base frame.
Figure 6B:
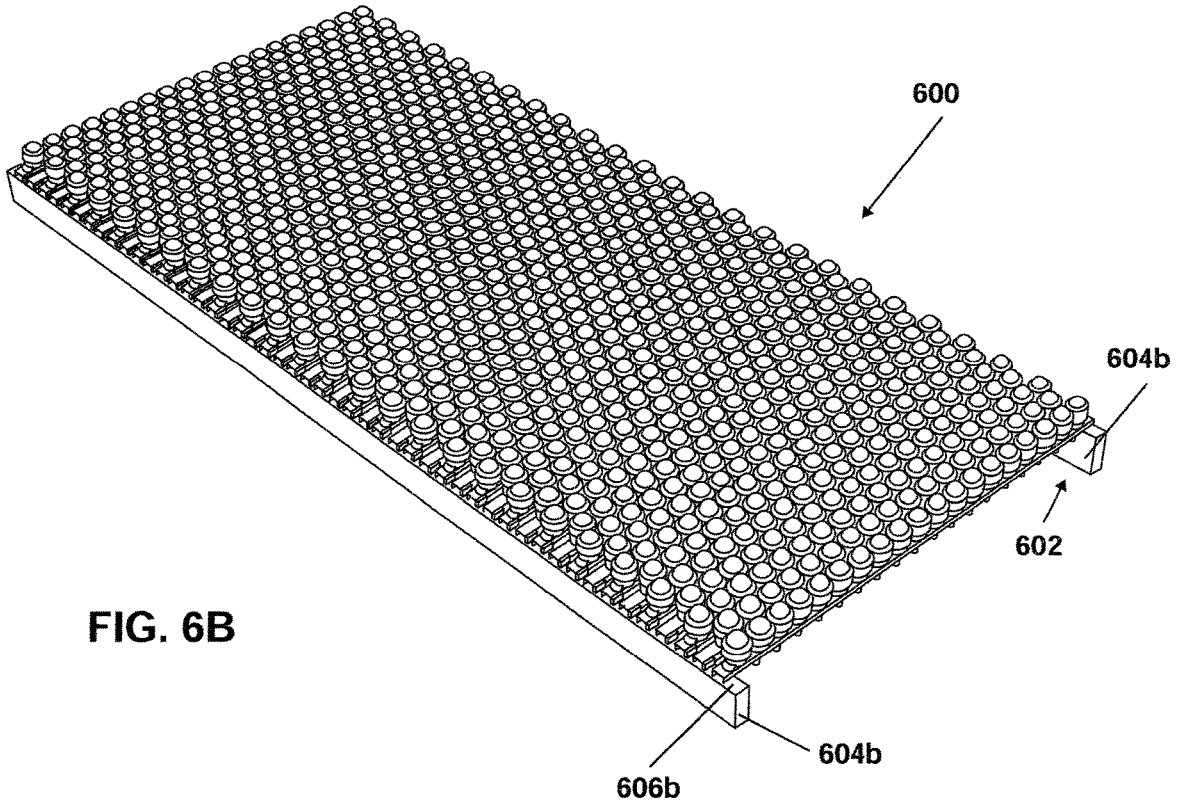

Reference is now made to FIGS. 6A and 6B, which are perspective view illustrations of a flat massage surface formed of a plurality of ball transfer unit blocks 300 mounted onto a linear base frame.

As seen in FIGS. 6A and 6B, massage surfaces 600 thereof each include a plurality of ball transfer unit blocks 300, arranged similarly to the arrangement shown in FIG. 4, mounted onto a base frame 602. Specifically, the ball transfer unit blocks 300 are arranged such that the brackets 200 thereof are disposed in parallel to one another, and the ball transfer units 10 of adjacent blocks 300 engage each other in a honeycomb structure.

In the embodiment of FIG. 6A, the base frame 602 includes a pair of frame walls 604*a* each including a planar, horizontal, upper surface 606*a*. A channel 608 is disposed along each of frame walls 604*a*, slightly beneath upper surface 606*a*, the channel defining a resting surface upon which rest the brackets 200 of the ball transfer unit blocks 300.

In the embodiment of FIG. 6B, the base frame 602 includes a pair of frame walls 604*b* each including a planar, horizontal, upper surface 606*b*. The brackets 200 of ball transfer unit blocks 300 rest directly on upper surface 606*b*.

As discussed hereinabove, the brackets 200 may be secured to their resting surface, be it the channel 608 or the upper surface 606*b*, using any suitable means, such as adhesive, soldering, nuts and bolts, nails, and the like.

Figure 7A:
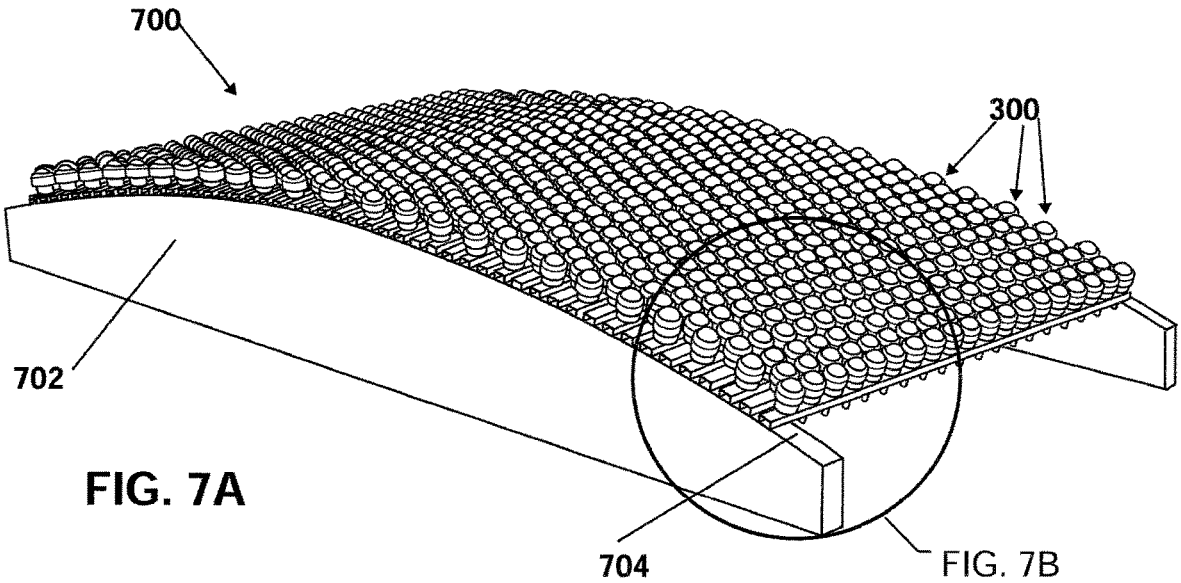
FIGS. 7A and 7B are perspective view illustrations of a convex massage surface formed of a plurality of ball transfer unit blocks of FIGS. 3A to 3D mounted onto a convex base frame, FIG. 7B being an enlargement of a portion of FIG. 7A.
Figure 7B:
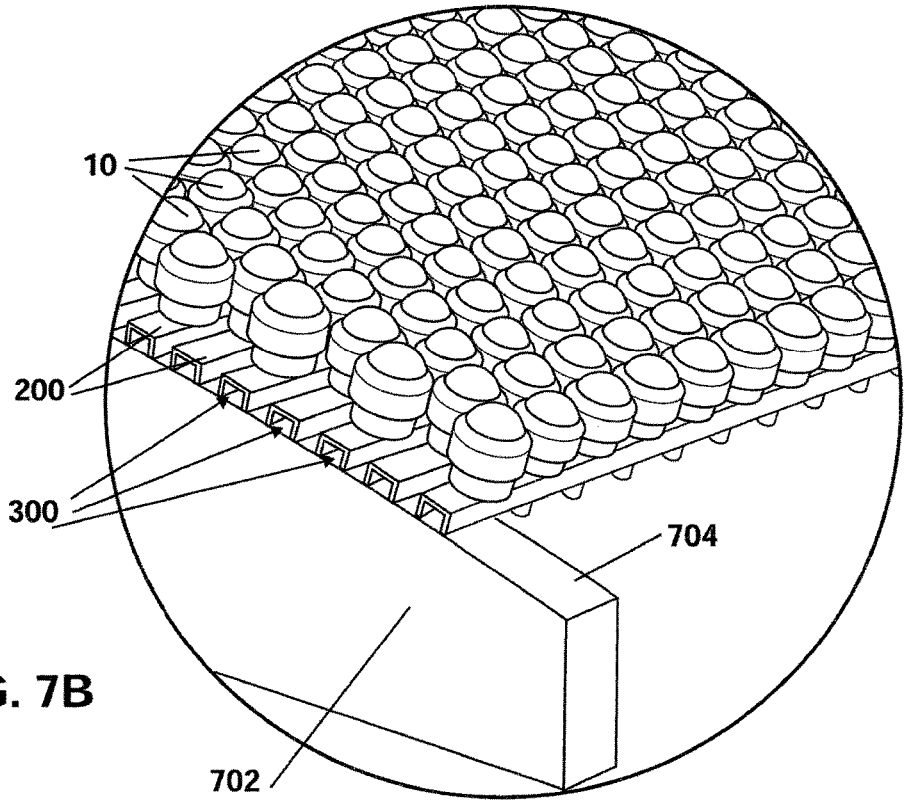

Reference is now made to FIGS. 7A and 7B, which are perspective view illustrations of a convex massage surface 700 formed of a plurality of ball transfer unit blocks 300 mounted onto a convex base frame, FIG. 7B being an enlargement of a portion of FIG. 7A.

As seen, the convex massage surface 700 includes two frame walls 702, each terminating, at an upper end thereof, in a convex surface 704. A plurality of ball transfer unit blocks 300, arranged similarly to the arrangement shown in FIG. 4, mounted onto a convex surface 704.

Specifically, the ball transfer unit blocks 300 are arranged such that the brackets 200 thereof are disposed in parallel to one another, and the ball transfer units 10 of adjacent blocks 300 engage each other in a honeycomb structure.

Figure 8:
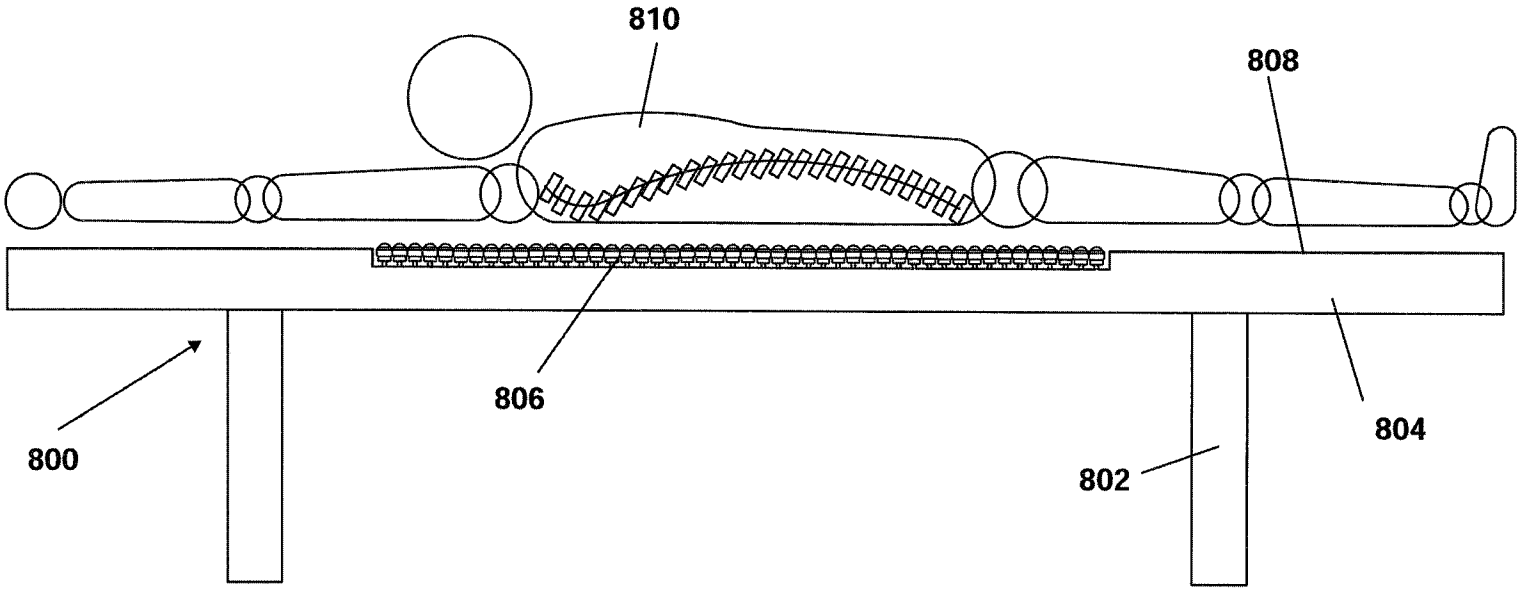
FIG. 8 is a schematic illustration of using a massage table including the flat massage surface of FIG. 6A or 6B to stretch the spine of a subject lying on the massage table.

Turning now to FIG. 8, the Figure is a schematic illustration of a massage table 800 including a flat massage surface, similar to the massage surfaces shown in FIGS. 6A and 6B, being used to stretch the spine of a subject lying on the massage table.

As seen in FIG. 8, the massage table 800 includes table supports 802, which may be table legs as known in the art, and a table plate 804. Table plate 804 includes, in a portion thereof, a flat massage surface 806, which may be similar to massage surfaces 600 described hereinabove with reference to FIGS. 6A and 6B. Other portions of table plate 804 do not define a massage surface and have a flat or horizontal upper surface 808. In some embodiments, the motion transfer balls of the massage surface 806 are disposed above upper surface 808. In other embodiments, the motion transfer balls are flush with upper surface 808.

The massage table 800 is usable to promote relaxation of muscles, and consequently, straightening and decompression of the spine. In the illustrated embodiment, a user 810 is lying on table plate 804 such that at least a torso thereof is disposed above massage surface 806. In some embodiments, the massage surface 806 is constructed such that the user's body only engages the motion transfer balls 140 and does not touch the housing elements 110 of the ball transfer units 10.

Placement of the user's body on the flat massage surface, which has reduced friction as described hereinabove, allows the body and the spine to straighten due to the impact of gravity on the body. Specifically, as explained hereinabove, the massage surface 806 is constructed such that the ball transfer units 10 are attached to the brackets 200 without limiting the movement of ball bearings 130 or of motion transfer ball 140, and each motion transfer ball 140 is capable of omnidirectional movement irrespective of movement of other ball transfer units. When the torso of user 810 is placed on the massage surface 806, relative motion of the ball transfer units 10 results in spreading out of the mass of the user's torso on the massage surface 806, or stretching the user's torso, in a similar manner to that of rolling out dough on a surface dusted with flour. When using massage table 800, simply turning the body of user 810 body on its side, on its stomach or on its back, you can achieve such a stretching effect for all areas of the spine and surrounding the spine.

Additionally, carrying a traditional massage, applied by a massage therapist or other person while user 810 lies on massage table 800, may enhance the stretching effect described above. This may be due to the fact that, as a result of the massage, the muscular framework surrounding and supporting the spine will relax, and slight pressure applied to the body during the massage promotes even greater spreading of the body and the spine along the table surface. Consequently, decompression of the spine will increase.

Furthermore, each of the ball transfer units 10 may function as an individual massage point, in part due to the fact that the motion of motion transfer ball 140 of each ball transfer unit 10 is capable of omnidirectional rotation independent of the motion of any other ball or ball transfer unit. As such, when the torso of user 810 is placed on the massage surface 806, each ball transfer unit provides a separate massage point, such that a massage of multiple points, similar to a "shiatzu massage" occurs in parallel.

In some embodiments, the massage table 800, and specifically the massage surface 806, may further include one or more vibrational elements and a control mechanism for adjusting the amplitudes and periods of vibration of the vibrational elements. Vibration of the ball transfer units 10 during placement of the user's body thereon may further decompress the spine and enhance the muscle relaxation effects of the massage.

In some embodiments, the planar massage surface 806 may be replaced by a convex massage surface, similar to that shown in FIGS. 7A and 7B. A convex massage surface allows for a greater stretching force due to stretching of the muscles to conform to the shape of the surface, and as a result, to a higher degree of decompression of the spine. Additionally, on a convex massage surface, it is possible not only to straighten the spine, but also to bend the spine in a desired direction.

In some embodiments, a physical activity may be performed on the massage table, the physical activity including at least one of massage, sports exercise, medical exercise, muscle rehabilitation exercise, joint rehabilitation exercise, spinal decompression, and post-traumatic rehabilitation. The reduced friction provided by the massage surface may enable the user to invest less force in such physical activity, thereby resulting in the user achieving a greater range of motion and/or conserving more energy while carrying out the physical activity.

Figure 9A:
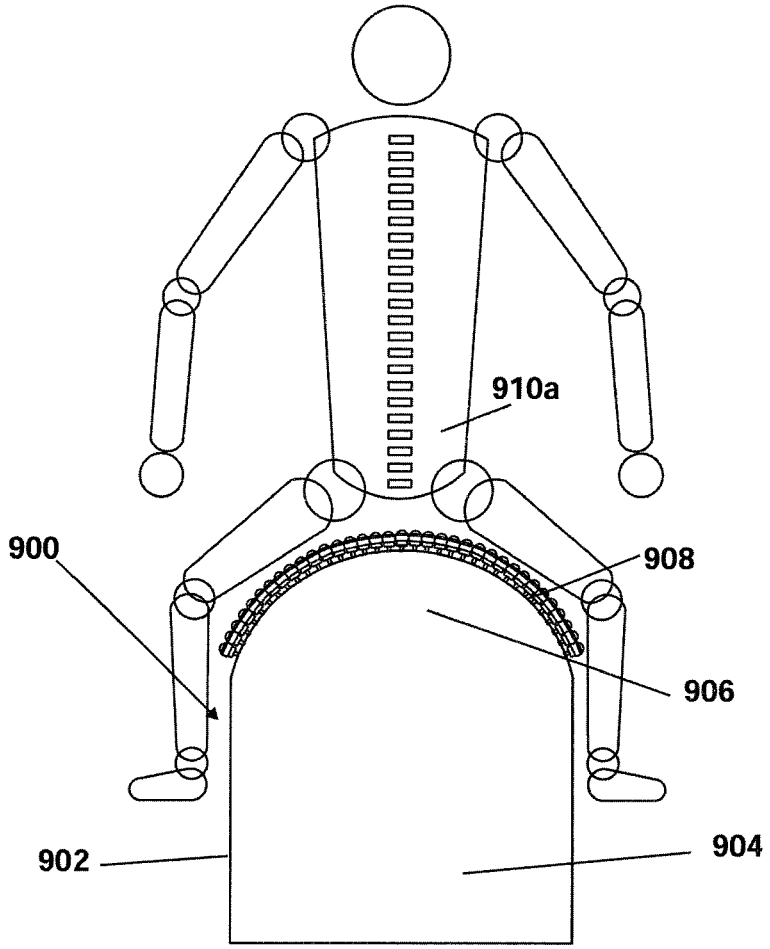
FIGS. 9A and 9B are schematic illustrations of using a convex massage barrel constructed according to the present invention, to stretch the hip joints of a human subject straddling the massage barrel and to stretch the spine of a subject lying on the massage barrel.
Figure 9B:
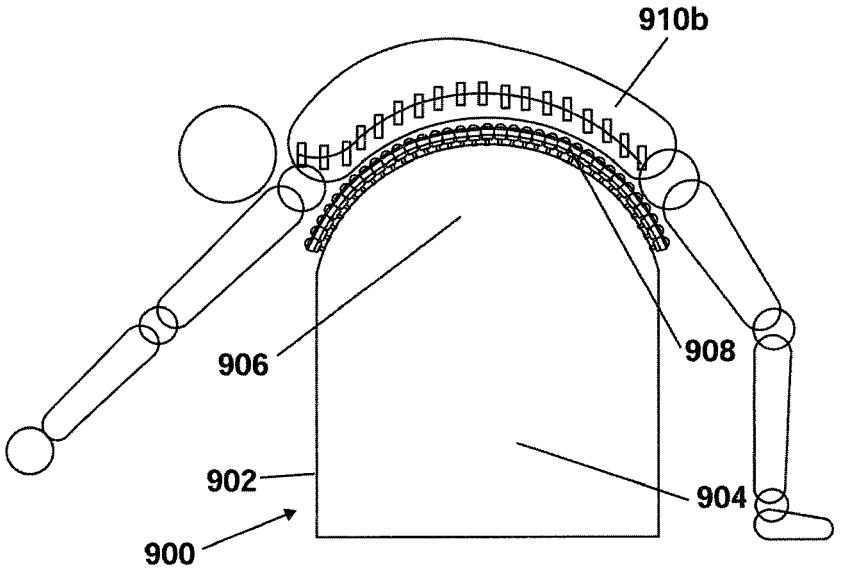

FIGS. 9A and 9B are schematic illustrations of using a convex massage barrel 900 constructed according to the present invention, to stretch the hip joints of a human subject straddling the massage barrel and to stretch the spine of a subject lying on the massage barrel.

As seen, convex massage barrel 900 is formed of a base frame 902 including frame walls, each including a quadrilateral portion 904, and a convex portion 906. Mounted onto the convex portion 906 of the base frame 902 is a massage surface 908, including a plurality of ball transfer unit blocks 300, substantially as described hereinabove with respect to FIGS. 7A and 7B. Massage barrel 900 is particularly characterized in having substantially large curvature of convex portion 906. In some embodiments, the radius of curvature of convex portion 906 is in the range of 10 to 20 inches.

Turning specifically to FIG. 9A, a user 910*a* is straddling massage surface 908, such that the hips of the user engage massage surface 908, and the user's legs hang down alongside quadrilateral portion 904. In this position, the user's hip joints are stretched. This is particularly due to the fact that the reduced friction allows the user's legs to extend downward with gravity, without the user having to apply force to overcome the friction between the massage barrel and his body. Additionally, if weights are placed on the legs, and the user swings the legs back and forth, no burden is applied to the legs while restoring and strengthening ligaments and muscles that ensure the operability of the hip joint.

In FIG. 9B, a user 910*b* is lying over the barrel such that his torso is aligned with the massage surface 908. It is appreciated that placing a user's body on a strongly curved surface, such as massage surface 908, greatly increases the degree of decompression action on the spine relative to when using a flat massage surface, regardless of whether the user is on his stomach, back, or side. Stretching of the spine on such a curved surface, even without additional load (known as passive stretching), also provides greater decompression of the spine than when using a massage surface having lower curvature. Performance of physical exercises on massage barrel 900, when the body is forced from a curved positon to a horizontal position by forces of the muscles, or when the body bends in the opposite direction to the curvature of the barrel 900 (as in a sit-up), is designed to reinforce and/or fix the effect of decompression of the spine, and to strengthen the muscular corset surrounding the spine.

The reduced friction of massage surface 908, stemming from use of ball transfer units, is advantageous when using a massage barrel for similar reasons to those described hereinabove with respect to FIG. 8, such as for the effect of spreading out the spine, and for the creation of multiple pressure points.

Figure 10A:
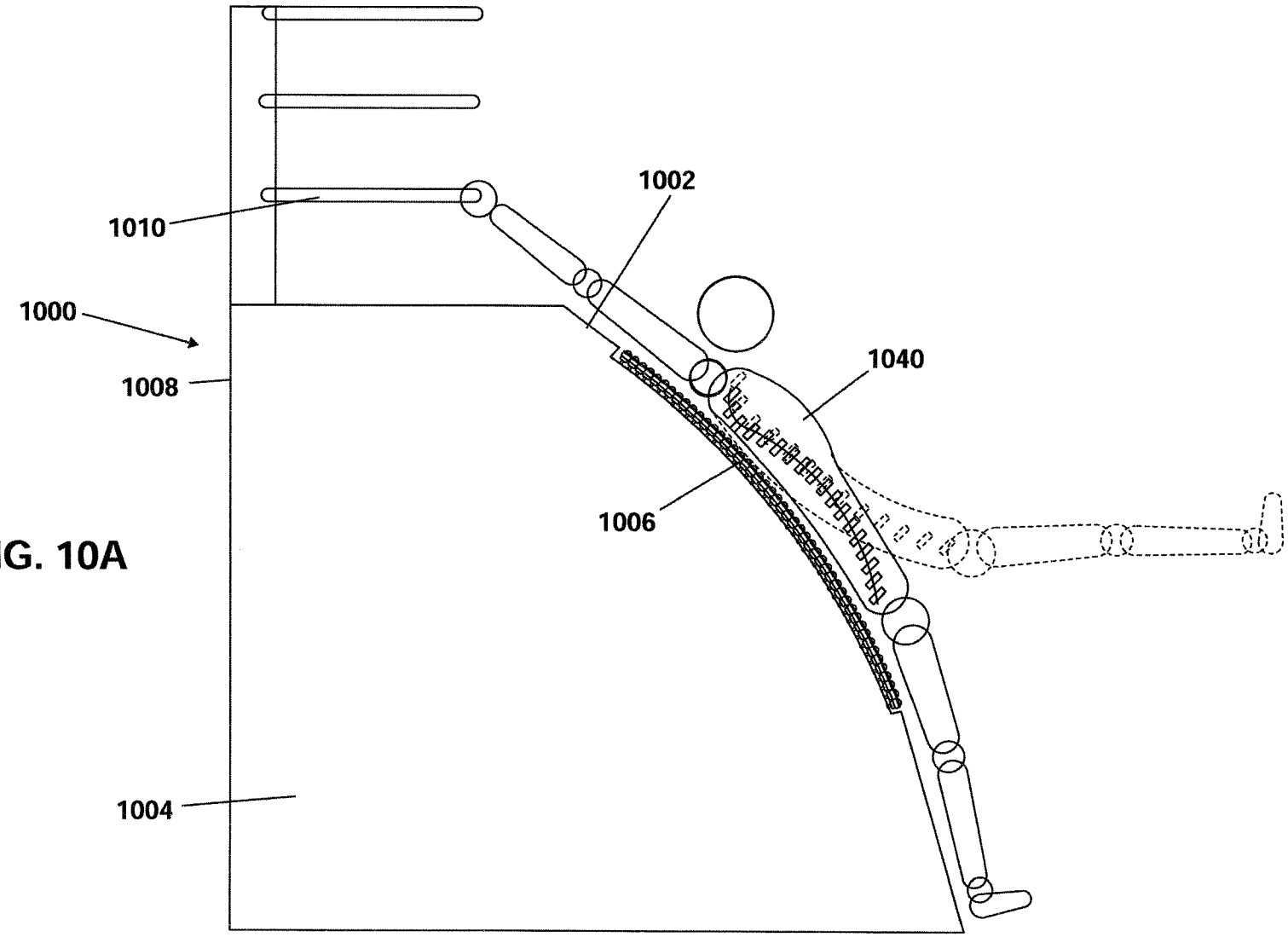
FIGS. 10A and 10B are schematic illustrations of using a massage surface, constructed according to the present invention, for performing exercises and stretching the spine of a human subject against gravity, where in FIG. 10A the massage surface is convex, and in FIG. 10B the massage surface is flat.
Figure 10B:
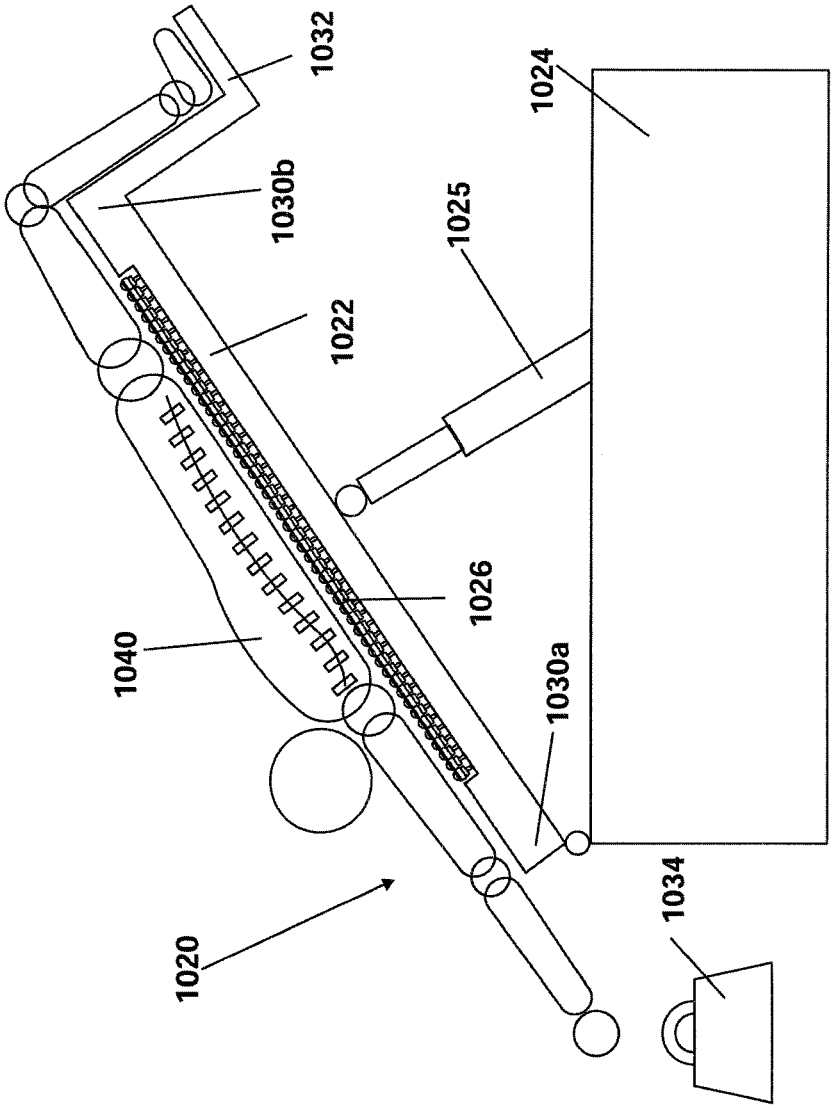

FIGS. 10A and 10B are schematic illustrations of using a massage surface, constructed according to the present invention, for performing exercises and stretching the spine of a human subject against gravity, where in FIG. 10A the massage surface is convex, and in FIG. 10B the massage surface is flat. Specific examples of exercise machines using a massage surface are described hereinbelow with reference to FIGS. 12A to 20C.

As seen in FIG. 10A, an exercise machine 1000, which may, for example, be a "Swedish wall", has a convex surface 1002 which is elevated from the ground by a base portion 1004. A massage surface 1006, similar to the massage surfaces of FIGS. 6A to 7B, is disposed on a portion of convex surface 1002. Attached to a bottom surface 1008 of base portion 1004 are a plurality of loads or anchors 1010, which may be held or manipulated by a user.

FIG. 10B illustrates massage table 1020 which includes a flat table 1022 mounted onto a base portion 1024 via an elevation mechanism 1025. Table 1022 is substantially similar to table plate 804 of FIG. 8, and includes a planar massage surface 1026, which may be similar to massage surfaces 600 of FIGS. 6A and 6B. In some embodiments, table 1022 includes first and second ends 1030*a* and 1030*b*, and an L-shaped leg rest 1032 is connected to second end 1030*b* and hangs downwardly therefrom.

The elevation mechanism 1025 is adapted to elevate at least a portion of table 1022 relative to base portion 1024, and may be hydraulic, pneumatic, or any other suitable type of elevation element. In the illustrated embodiment, table 1022 is elevated such that first end 1030*a* engages the base portion 1024, and leg rest 1032 is elevated in the air above the base portion. As such, in the embodiment of FIG. 10B, table 1022 is slanted relative to base portion 1024. Free standing weights, such as kettle ball 1034, dumbbells, or other weights may be disposed adjacent massage table 1020 for use during treatment thereon.

Exercise machine 1000 of FIG. 10A and massage table 1020 of FIG. 10B are used in a similar manner. A user 1040 lies on convex surface 1002 or on an upper surface of table portion 1022, such that at least a torso thereof is disposed on the massage surface 1006 or 1026. In the embodiment of FIG. 10A, the user 1040 lies on the surface 1002 such that the head thereof is disposed higher than the knees, whereas in the embodiment of FIG. 10B, the user lies on the surface 1022 such that the head of the user 1040 is disposed lower than the knees of the user, and the user is facing "down-hill" on the device relative to the horizontal plane.

The devices of FIGS. 10A and 10B are designed for passive (no added load) and active (with added loads) decompression of the spine and restoration of the mobility of the musculoskeletal system. Using the devices 1000 and 1020, stretching and/or decompression of the spine is achieved by placing the human body on the reduced friction surface defined by massage surface 1006 or 1026, while the reduced friction surface is inclined relative to the horizontal plane. The body of the user 1040 is fixed to the inclined surface, for example by holding anchors 1010 of device 1000 of FIG. 10A, or by anchoring the shins of the user to the leg-rest 1032 of massage table 1020 of FIG. 10B. Such fixation does not allow the user to slip along the reduced friction surface 1006 or 1026 under the gravitational force, while assisting in stretching the spasmodic muscles and decompressing and/or stretching the spine and joints. The degree of stretching and decompression can be adjusted by adjusting one or more of the following:

- an angle of inclination of reduced friction surface on which the human body is placed—this adjusts the passive decompression; and
- a load pulling down any part of the body below the point at which the body is fixed to the inclined surface—this adjusts active decompression.

Various physical exercises may be carried out on the devices of FIGS. 10A and 10B, when the user's body is downwardly inclined and vertical loads are removed from the spine and joints may include:

pull ups when holding an anchor, such as anchors 1010;

lifting the legs and bending the torso, as illustrated by dashed lines in

FIG. 10A;

flexion and extension of the torso; and hand work with free loads, such as kettlebells or dumbbells 1034 illustrated in FIG. 10B.

More generally, at a time when the spine and joints are in a stretched state, any additional decompression action exerted or carried out helps to restore the mobility of the musculoskeletal system.

Figure 11A:
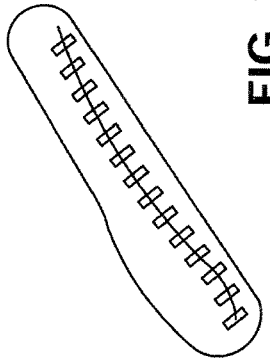
FIGS. 11B and 11A schematically represent the human spine in the compressed state and in the stretched (decompressed) state, respectively.
Figure 11B:
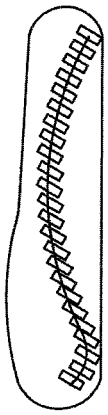

Reference is now made to FIGS. 11A and 11B, which are schematically represent the human spine in the compressed state and in the stretched (decompressed) state, respectively. Comparison of FIG. 11A, in which the user's torso is inclined and the spine is well stretched, to FIG. 11B, in which the user's torso is horizontal, or laying on a flat surface, and the vertebrae of the spine remain very close to one another, illustrates the advantages of using the systems of FIGS. 10A and 10B for spinal decompression, as compared to using a massage table having a flat surface, such as the massage table of FIG. 8.

Figure 12A:
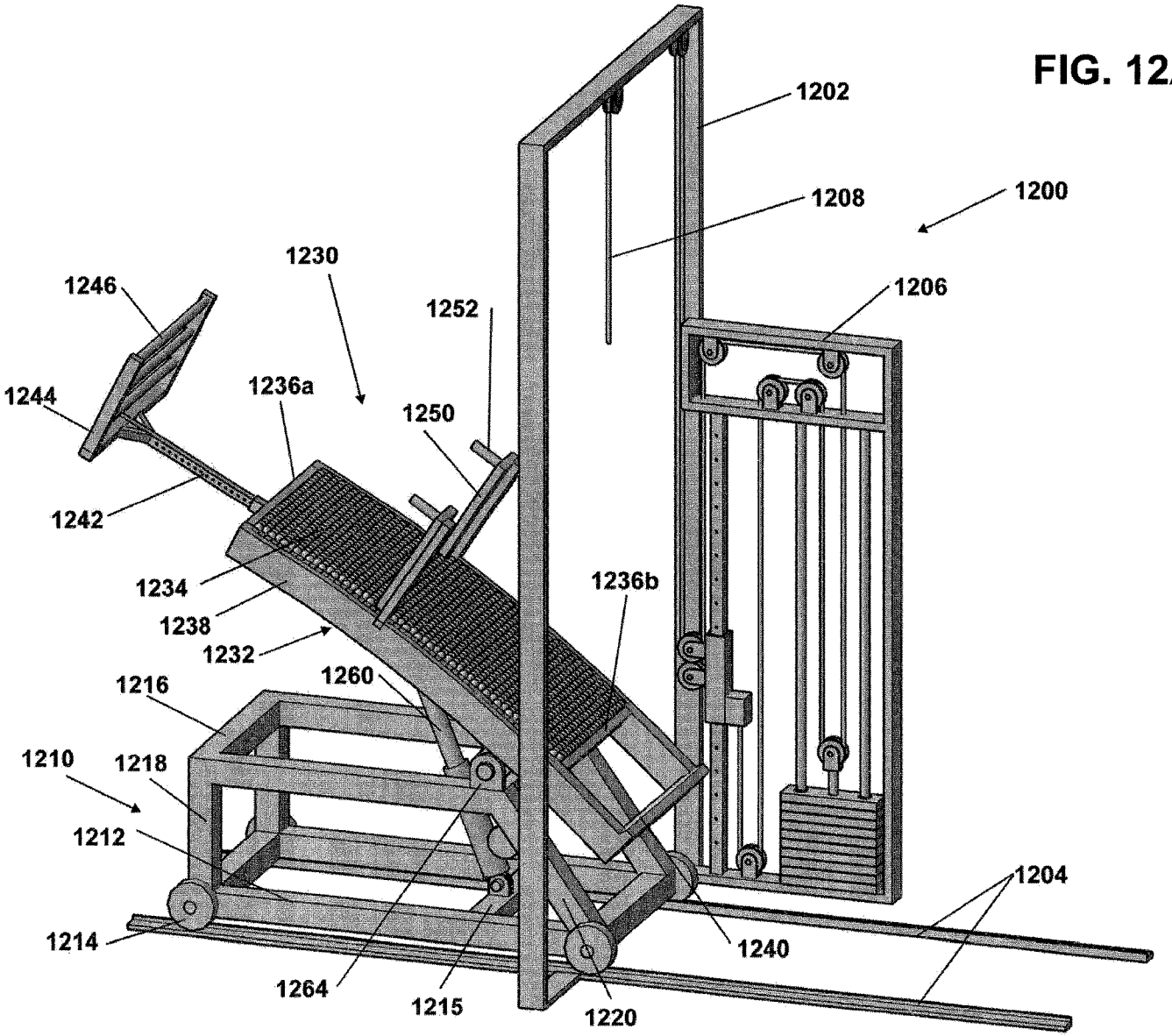
FIGS. 12A and 12B are a perspective view illustration and a side view planar illustration of a vertical massage-surface exercise machine constructed according to the present invention.
Figure 12B:
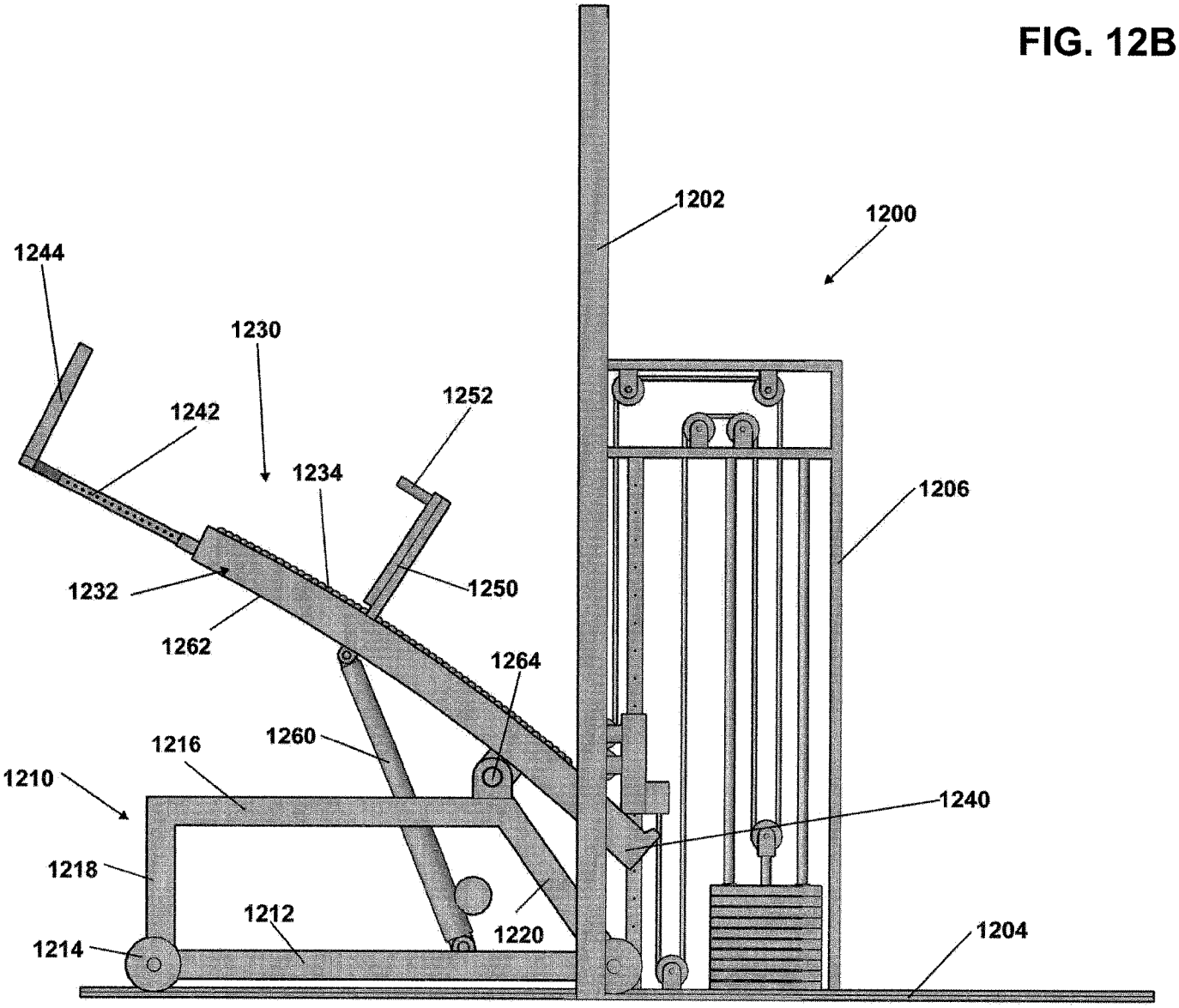

Reference is now made to FIGS. 12A and 12B, which are a perspective view illustration and a side view planar illustration of a vertical massage-surface exercise machine 1200 constructed according to the present invention.

As seen in FIGS. 12A and 12B, vertical massage-surface exercise machine 1200 includes a vertically arranged frame 1202, having connected thereto a pair of guides 1204 extending along a base surface of the machine 1200. Frame 1202 is functionally associated with, and is connected to an exercise cable column 1206, as known in the art. A roller guiding cable 1208 extends from exercise cable column 1206 along part of frame 1202 and downwardly therefrom via a plurality of rollers, as is known in the art. The guiding cable 1208 enables a user to exercise using cable column 1206 when using massage surface exercise machine 1200, as described hereinbelow with reference to FIGS. 14A to 14C.

A base-frame 1210 includes a first generally rectangular frame portion 1212 functionally associated with a plurality of wheels 1214, adapted to be movable along guides 1204. An additional transverse bar 1215 extends within frame portion 1212. Base-frame 1210 further includes a second, generally rectangular frame portion 1216, such that planes defined by frame portions 1212 and 1216 are generally parallel to one another. Two pairs of bars 1218 and 1220 connect frame portions 1212 and 1216 to one another.

In some embodiments, such as the illustrated embodiment, frame portion 1216 has a smaller foot print than frame portion 1212, such that bars 1218 extend generally perpendicularly between the two frame portions, and bars 1220 extend from one end of frame portion 1212 to the end of the second frame portion 1216 and are angled relative to the planes defined by frame portions 1212 and 1216.

A massage surface assembly 1230 is connected to base-frame 1210 and is movable relative thereto as explained in further detail herein. Massage surface assembly 1230 includes a generally rectangular massage table 1232, defining a massage surface 1234. Massage table 1232 includes first and second longitudinal ends 1236*a* and 1236*b*, and two lateral ends 1238. Massage surface 1234 preferably is a low friction surface, for example formed of a plurality of ball transfer units 10 as described hereinabove with reference to FIGS. 6A to 7B. In some embodiments, massage surface 1234 is slightly convex along a longitudinal axis thereof, and is planar in the transverse direction, i.e. along a width thereof.

Extending from longitudinal end 1236*b* of massage table 1232 is a footrest 1240, adapted for a user to place his or her feet thereon, as described hereinbelow. Extending from the opposing longitudinal end 1236*a* of massage table 1232 is a telescopically extending bar 1242, terminating in a hand grip 1244. In some embodiments, hand grip 1244 includes multiple hand-grip bars 1246.

Telescopically extending bar 1242 is movable relative to massage table 1232, such that the length of bar 1242 extending beyond longitudinal end 1236*a* may be adjusted based on the height of the user, as described in further detail herein. In some embodiments, bar 1242 includes a plurality of bores, adapted to have a pin extending therethrough, thereby to set the extent to which bar 1242 extends beyond end 1236*a*, as known in the art of exercise machines.

A pair of removable arm supports 1250 are disposed along lateral ends 1238 of massage table 1232. In some embodiments, arm supports 1250 are adapted for placement of the user's forearms thereon, and each include a hand grip 1252 which may be gripped by the user's hand when the forearms are rested on supports 1250.

A connecting mechanism 1260 extends between transverse bar 1215 and a lower surface 1262 of massage table 1232 and facilitates changing of the angle of massage table 1232 relative to the horizon or to the base surface of machine 1200. The connecting mechanism 1260 can be formed based on any applicable conventional technology, including but not limited to a pneumatic, hydraulic, electromechanical, manual and other mechanisms. In some embodiments, the lower surface 1262 of massage table 1232 is further movably connected to one end of frame portion 1216, for example by an axle mechanism 1264, as illustrated in FIGS. 12A and 12B.

Figure 13A:
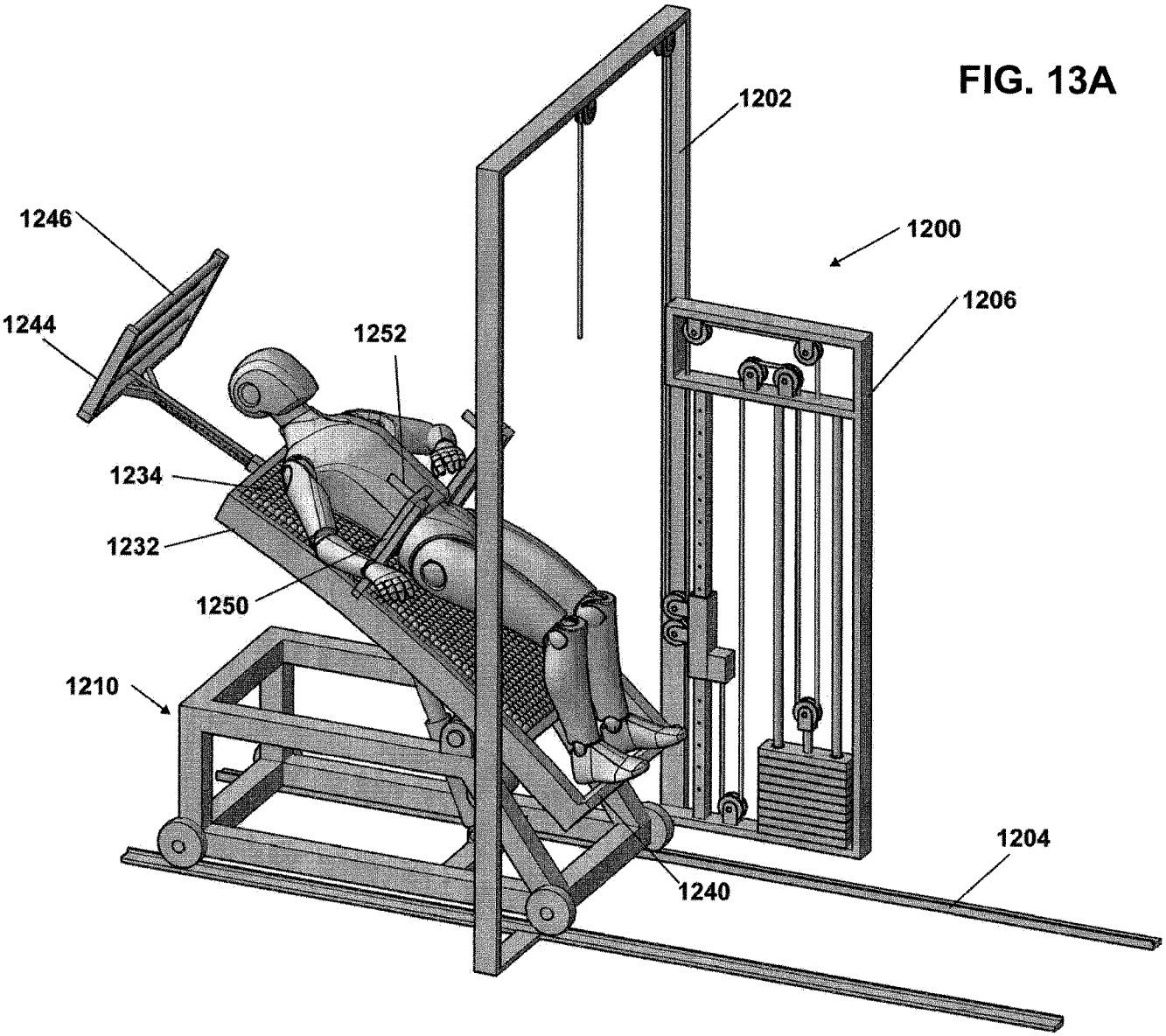
FIG. 13A is a schematic representation of a user positioned on a vertical massage surface and 13B is schematic representations of a user using the vertical massage-surface exercise machine of FIGS. 12A and 12B for spinal decompression based on the weight of the user.
Figure 13B:
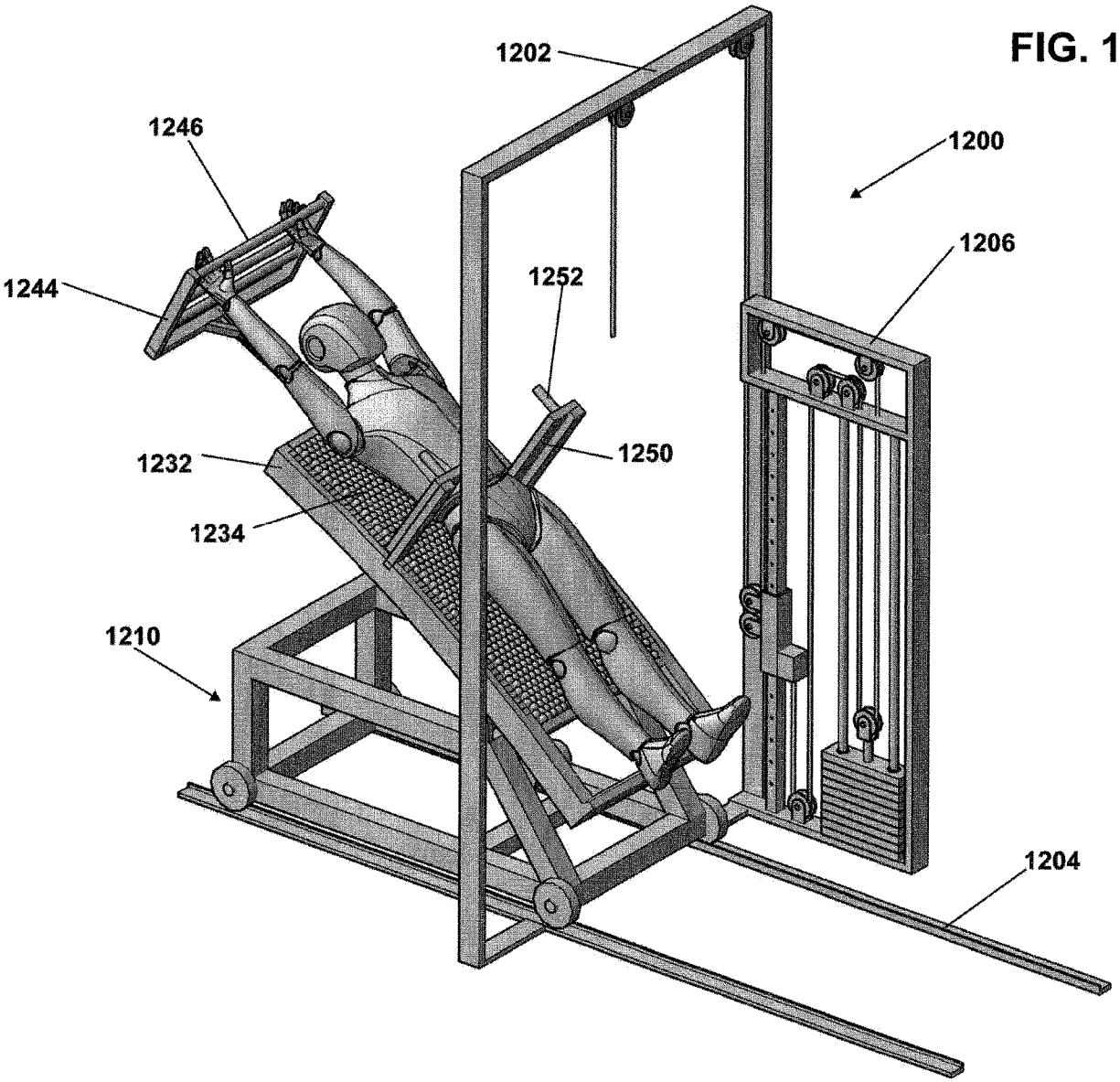

Turning now to FIGS. 13A and 13B, which are schematic representations of a user using the vertical massage-surface exercise machine 1200 for spinal decompression based on the weight of the user. As illustrated, the user mounts the machine 1200 such that the back and hips of the user are disposed along massage surface 1234, and the hand grips 1246 and hand rest 1250 are utilized. Prior to the user mounting the machine 1200, the user may set the angle of massage surface assembly 1230 relative to the horizon or to the base surface of machine 1200 by adjusting connecting mechanism 1260 and axle mechanism 1264. In machine 1200, the angle of inclination of massage surface assembly 1230 is such that when the user lies is on massage surface 1234, the user's head is disposed higher than his legs.

Once the user lies on massage surface 1234 with his feet in footrest 1240, the user may place his forearms on arm supports 1250 as illustrated in FIG. 13A, and may, if desired, hold onto hand grips 1252 with his hands. Alternately, the user may extend his arms overhead, and grip one of hand-grip bars 1246. When multiple hand-grip bars 1246 are provided, the user may select to grip the hand-grip bar on which to hold. In some embodiments, prior to mounting machine 1200, the user may adjust the length of bar 1242 as explained hereinabove, to be suitable for the height of the user and/or the length of the user's arms.

Once the user has positioned his hands in a comfortable position and is anchored to machine 1200 by gripping of his hands, the user may remove his feet from footrest 1240, as illustrated in FIG. 13B. In this position, the user's body attempts to slip downward under gravitational pull. Due to the convex profile of massage surface 1234 along the longitudinal axis thereof, the body and spine of the user flex slightly backwards, resulting in straightening of the upper third of the spine and in articulation of the cervical and thoracic spine aligns. Keeping the body from slipping by holding the hand-grip bars 1246 closer or farther from the plane of massage surface 1234 enables the user to choose the degree of deflection of his back, for the deflection to be effective but not cause severe discomfort.

In some embodiments, when the user holds one of hand-grip bars 1246 and has removed his feet from footrest 1240, the user may carry out exercises without use of additional weight, such, as, for example, leg raisers and cycling motions in the air.

Figure 14A:
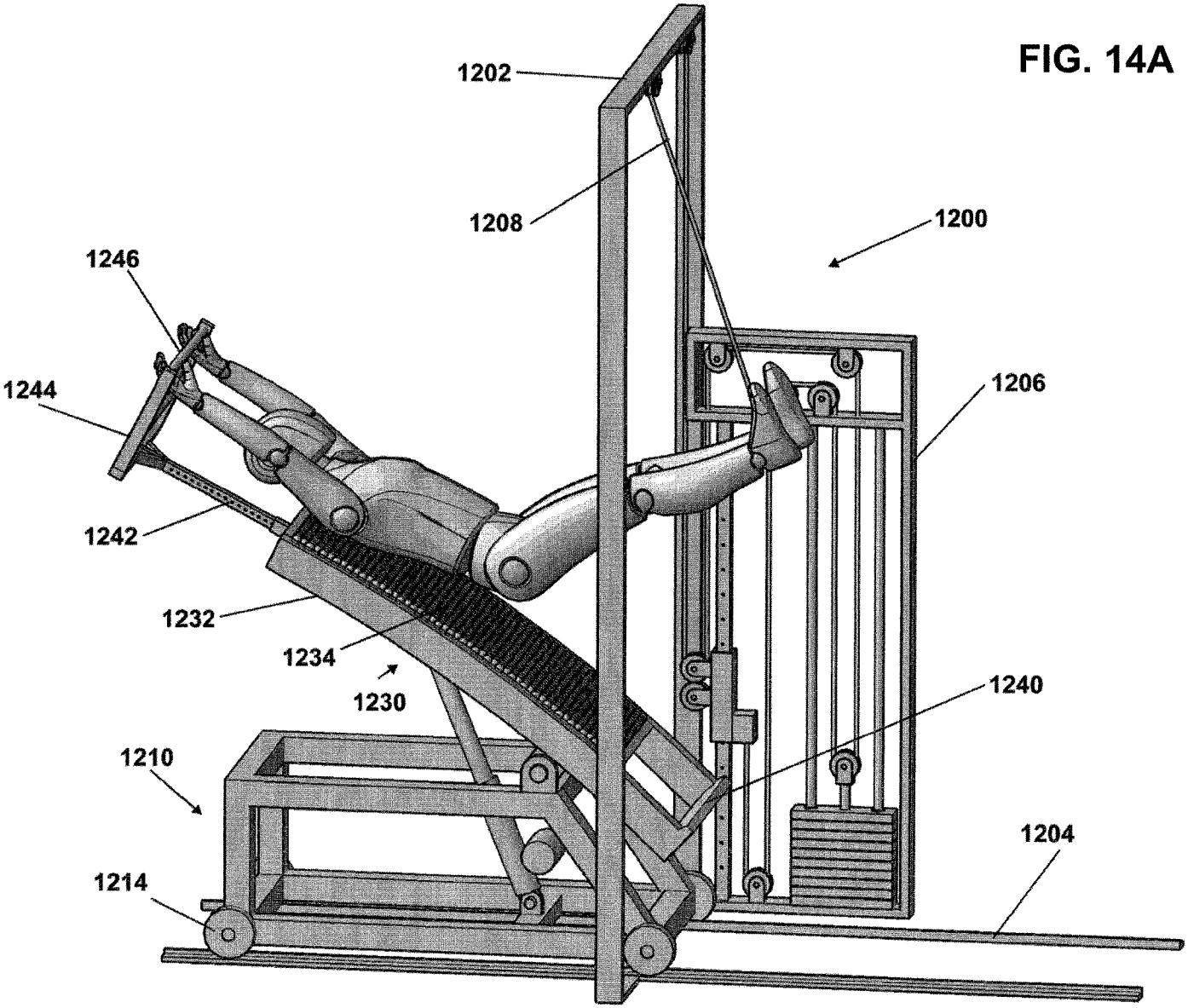
FIGS. 14A, 14B, and 14C are schematic representations of a user using the vertical massage-surface exercise machine of FIGS. 12A and 12B for performing exercises using additional weights.
Figure 14B:
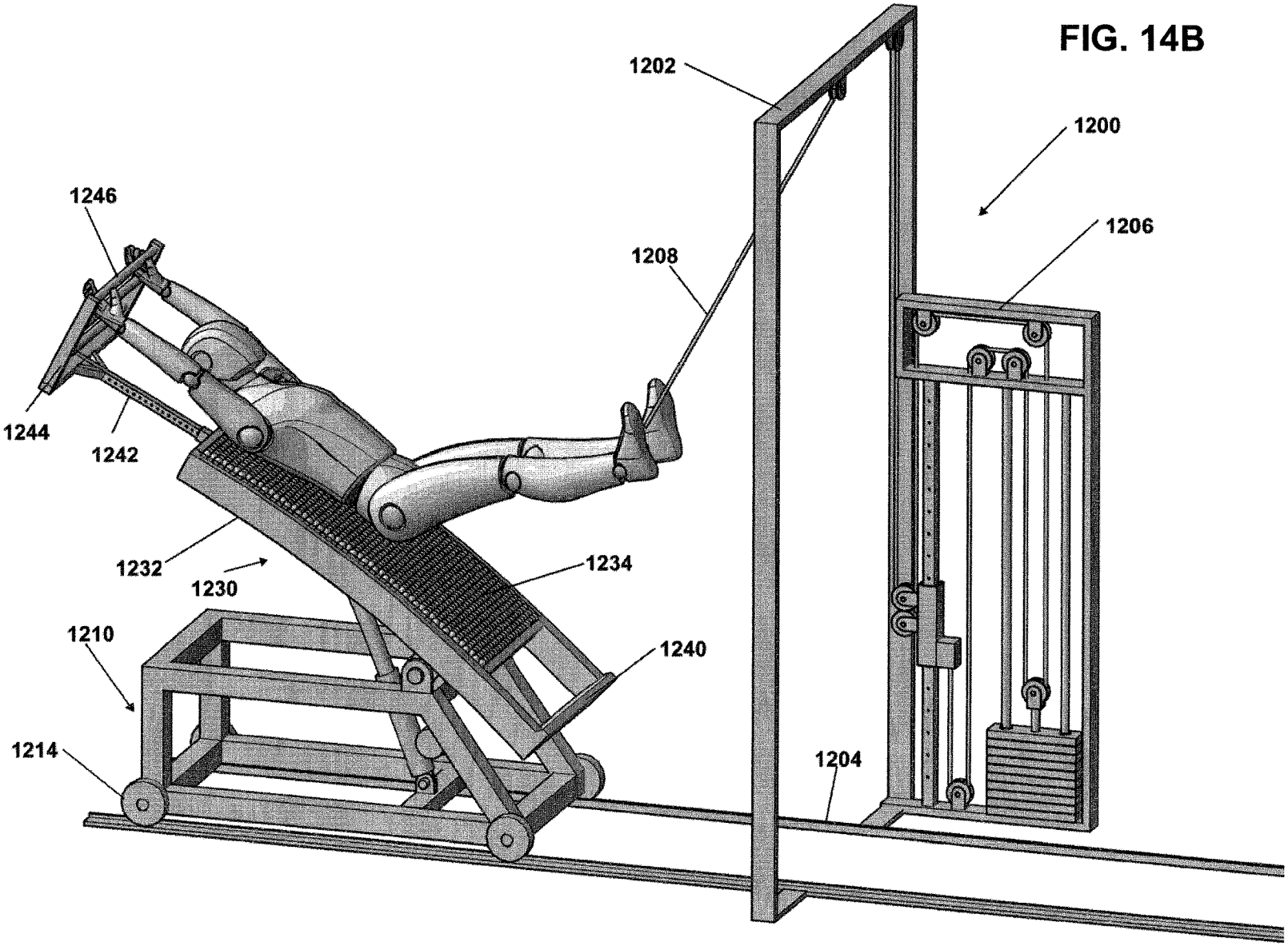
Figure 14C:
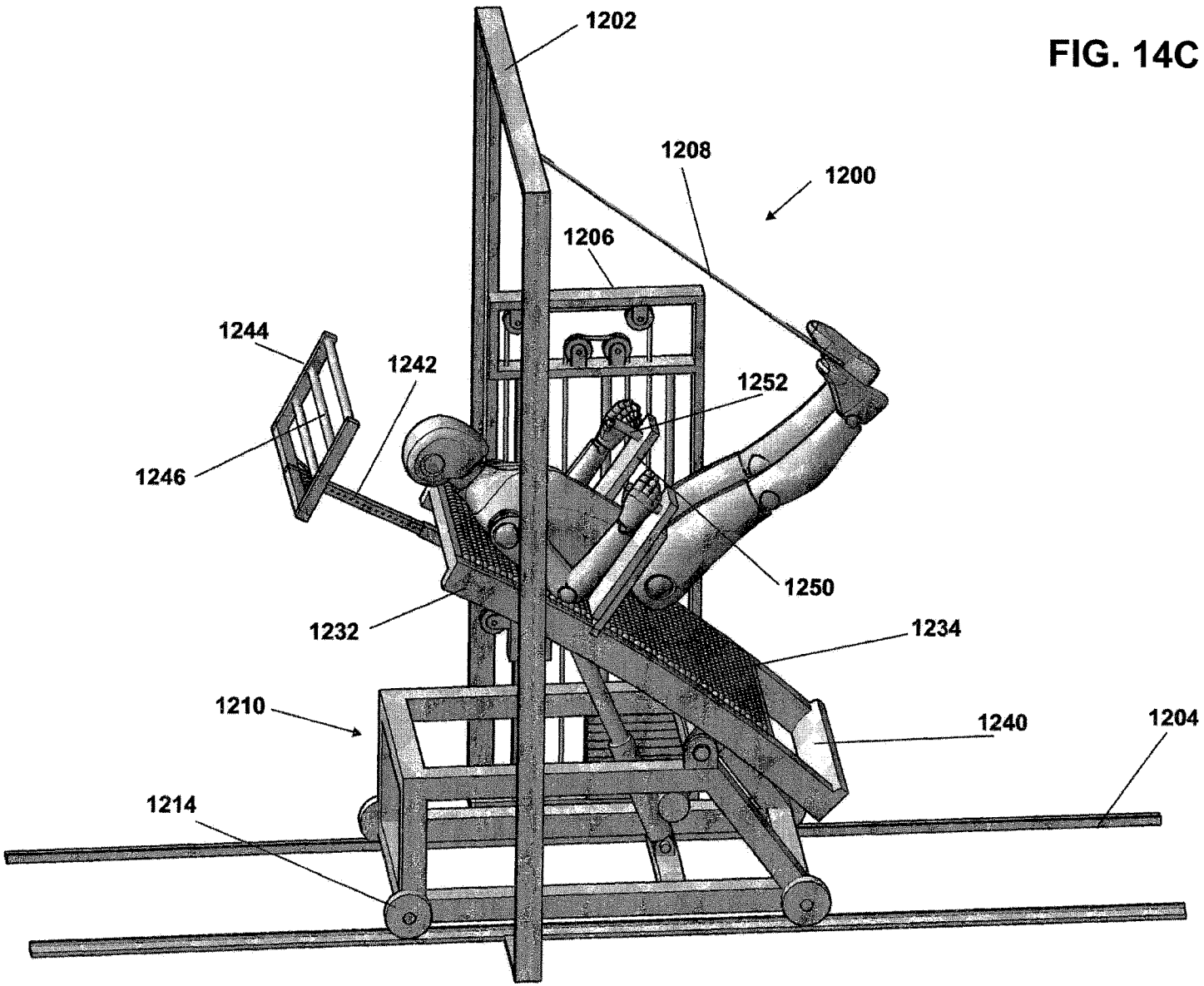

Reference is now made to FIGS. 14A, 14B, and 14C, which are schematic representations of a user using the vertical massage-surface exercise machine 1200 of FIGS. 12A and 12B for performing exercises using additional weights.

As seen in FIGS. 14A to 14C, cable 1208 extending from cable column 1206 via frame 1202 is attached to the user's legs by dedicated locks connecting the cable to the user's shoe(s) or ankle(s). When the user's hands are anchored, either by resting them on arm supports 1250 and gripping hand-grips 1252 or by gripping a hand-grip bar 1246, the user releases his legs, attached to cable 1208, from footrest 1240. The user can then raise and lower his legs, manipulating the weights on cable column 1206, to train one or more groups of muscles, while the user's back is flexed as described with respect to FIGS. 13A and 13B.

In the embodiments illustrated in FIGS. 14A to 14C, the initial position of the cable 1208, at which the weights of cable column 1206 are stacked and at rest, is when the legs of the user are raised. In these embodiments, extensor muscles, responsible for unbending the human body, are trained by the user lowering his legs some or all of the way to massage surface 1234 to lift the weight stack of cable column 1206, and then raising his legs to return the weights to their resting position. For this type of exercise, the cable 1208 is typically attached to the user's legs or shoes when the user's legs are raised, for example by a trainer, medical practitioner, or any other person helping the user. The load applied by the weight stack of cable column 1206 on the user when exercising is typically preset, but the user or by a helper thereof, in accordance with the user's physical ability and exercise plan.

In yet other embodiments, the cable 1208 and the weights on the weight stack 1206 may be arranged for a combined exercise aimed at simultaneously training both flexor muscles and extensor muscles. In such an arrangement, the cable 1208 is set such that the user exerts an effort both when lifting his legs and when lowering them.

It is a particular feature of machine 1200 that the gravitational pulling power granted by the reduced friction of massage surface 1234 serves to reduce the load on the trained muscle groups when performing physical exercises, to create the opportunity to train these muscles under loads that the person is able to overcome in accordance with his physical condition and exercise plan.

As discussed herein with respect to FIGS. 13A and 13B, the angle of inclination of massage surface 1234 may be adjusted and set by the user. Adjustment of the angle of inclination allows the user to select the degree to which gravitational pull will cause the user to slip along massage surface 1234, and thus the degree of decompression of the body and stretching of the muscles, joints and spine resulting from such slipping. Additionally, the arrangement of the user's body on massage surface 1234 such that the position of the user's head is higher than the position of the user's legs creates vertical decompression combining gravitation pull on the body under the body's own weight, and in the embodiments of FIGS. 14A to 14C stretching of the body through use of additional loads.

As seen from comparison of FIGS. 14A, 14B, and 14C, base frame 1210 together with massage surface assembly 1230 are movable relative to frame 1202 and cable 1208, by rolling of wheels 1214 along guides 1204. By changing the relative position of the frame 1202 and the massage surface assembly 1230, and the distance therebetween, the direction of thrust during the exercises may be changed. As a result, the point of maximum inflection of the spine when lifting the legs may be adjusted to be in the hip zone, lower, middle, or upper spine regions. Thus, by setting the location of massage surface assembly 1230, it is possible to influence directly different groups of muscles so as to restore and develop the flexibility of the spine in associated regions of the spine, including in the hip area.

Regardless of the relative locations of frame 1202 and massage surface assembly 1230, the angle of inclination of massage surface 1234, and the load applied or not applied by cable column 1206, the ball transfer units of massage surface 1234 provide acupressure to parts of the user's body leaning on or in contact with massage surface 1234 during the exercise and contribute to more complete stretching of the muscles, and correspondingly to more significant decompression of the user's spine and joints.

Figure 15A:
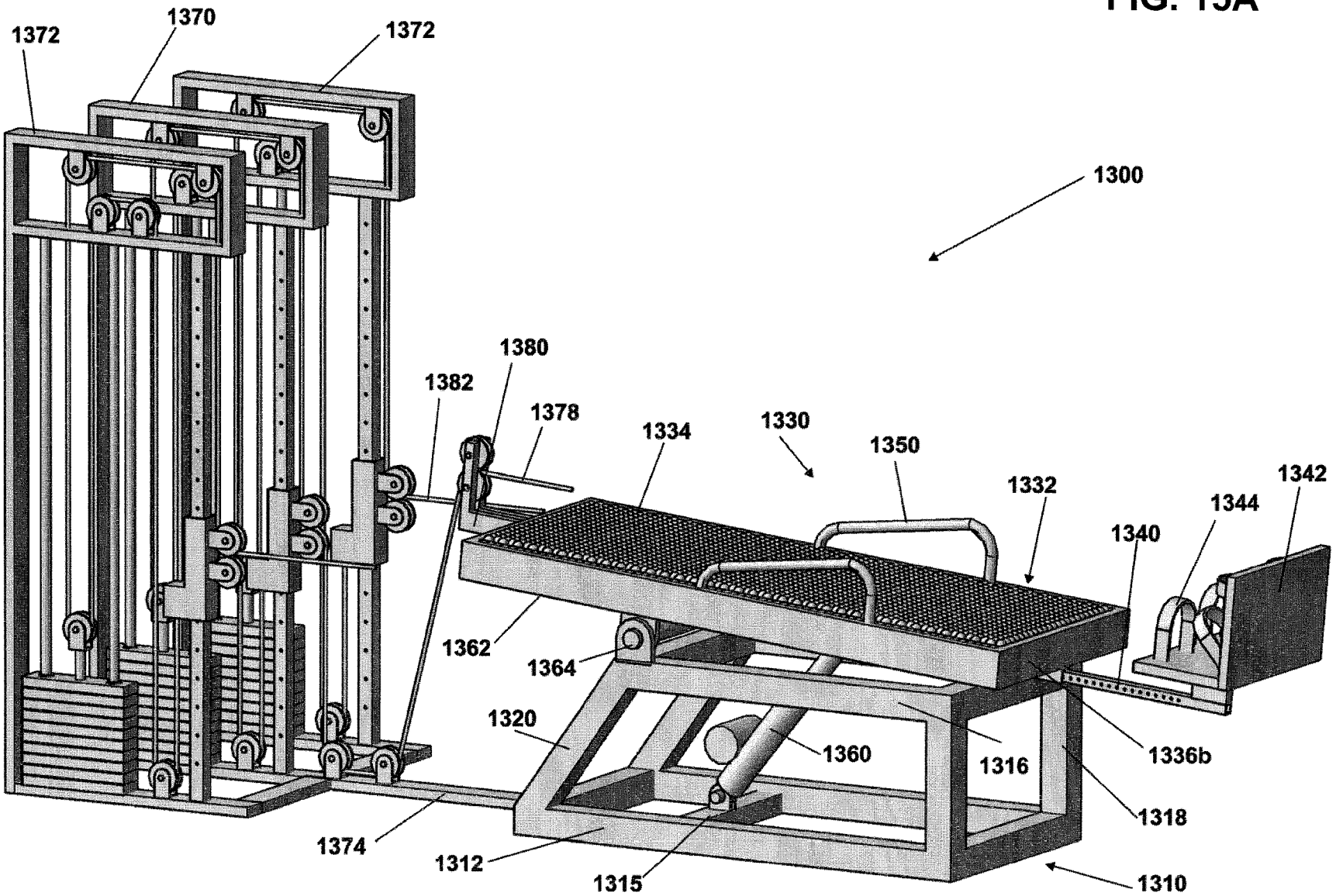
FIGS. 15A and 15B are a perspective view illustration and a side view planar illustration of an inversion massage-surface exercise machine constructed according to the present invention, in a user-mounting operative orientation.
Figure 15B:
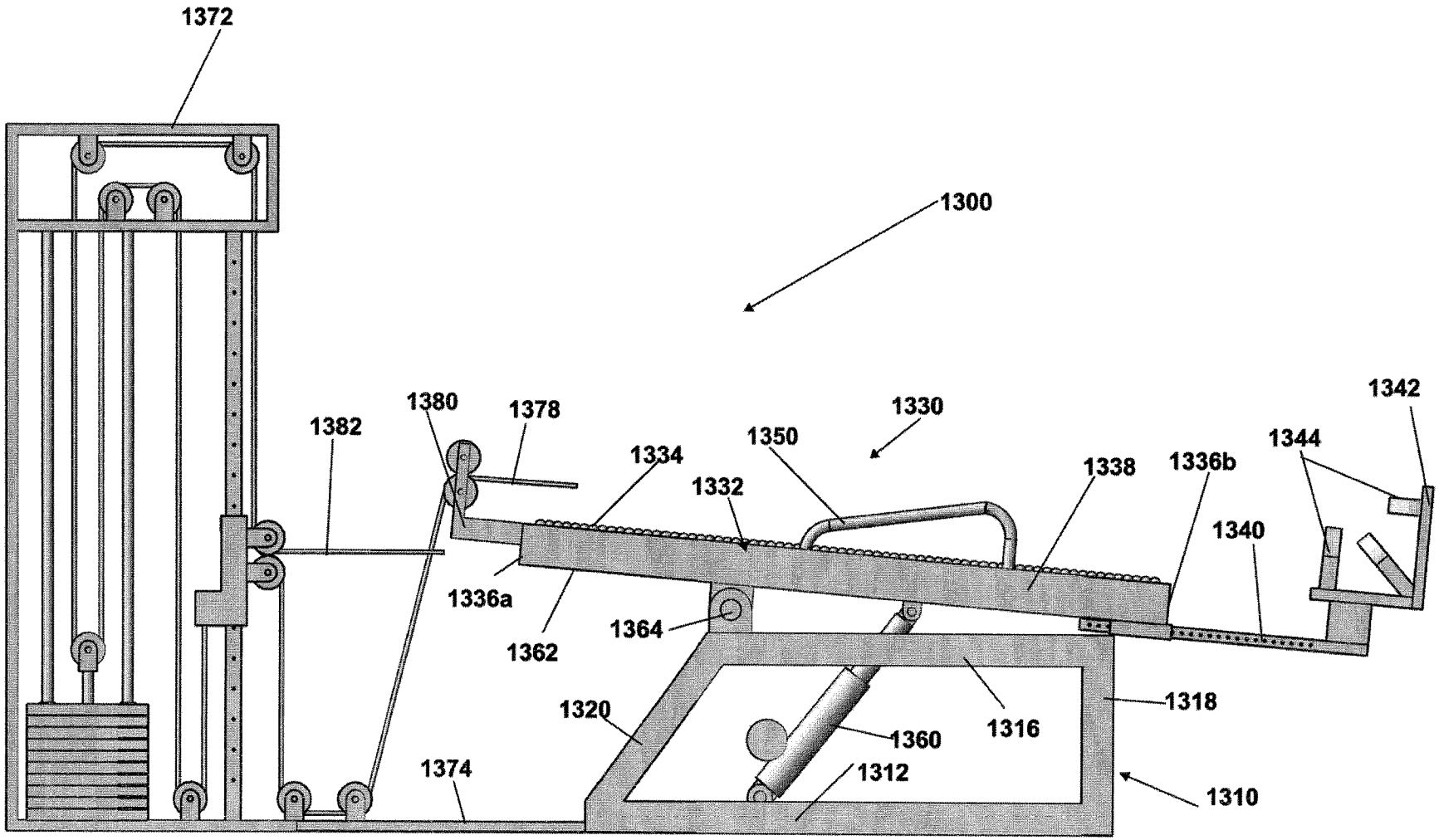
Figure 16A:
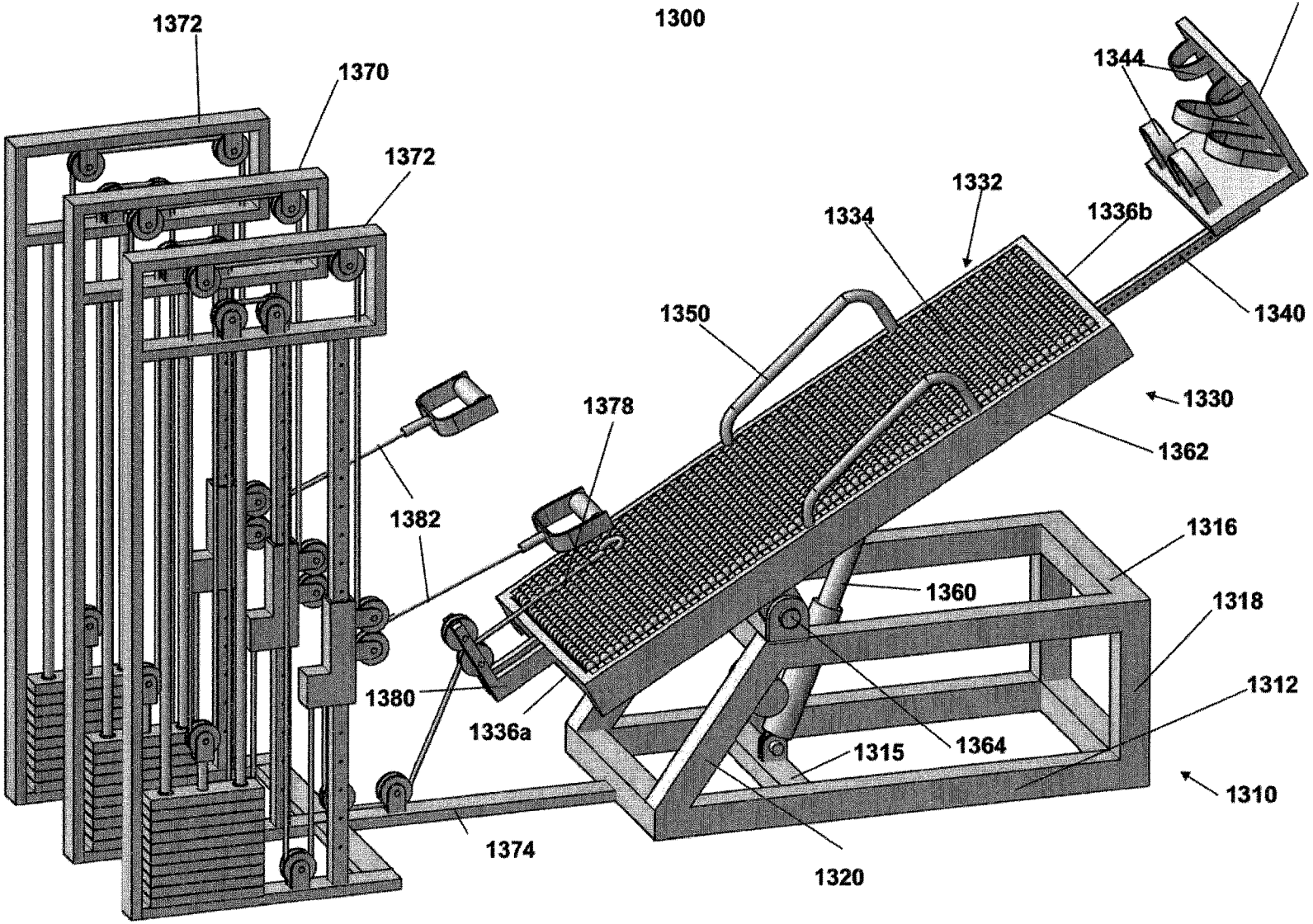
FIGS. 16A and 16B are a perspective view illustration and a side view planar illustration of the inversion massage-surface exercise machine of FIGS. 15A and 15B in an exercise and spinal decompression operative orientation.
Figure 16B:
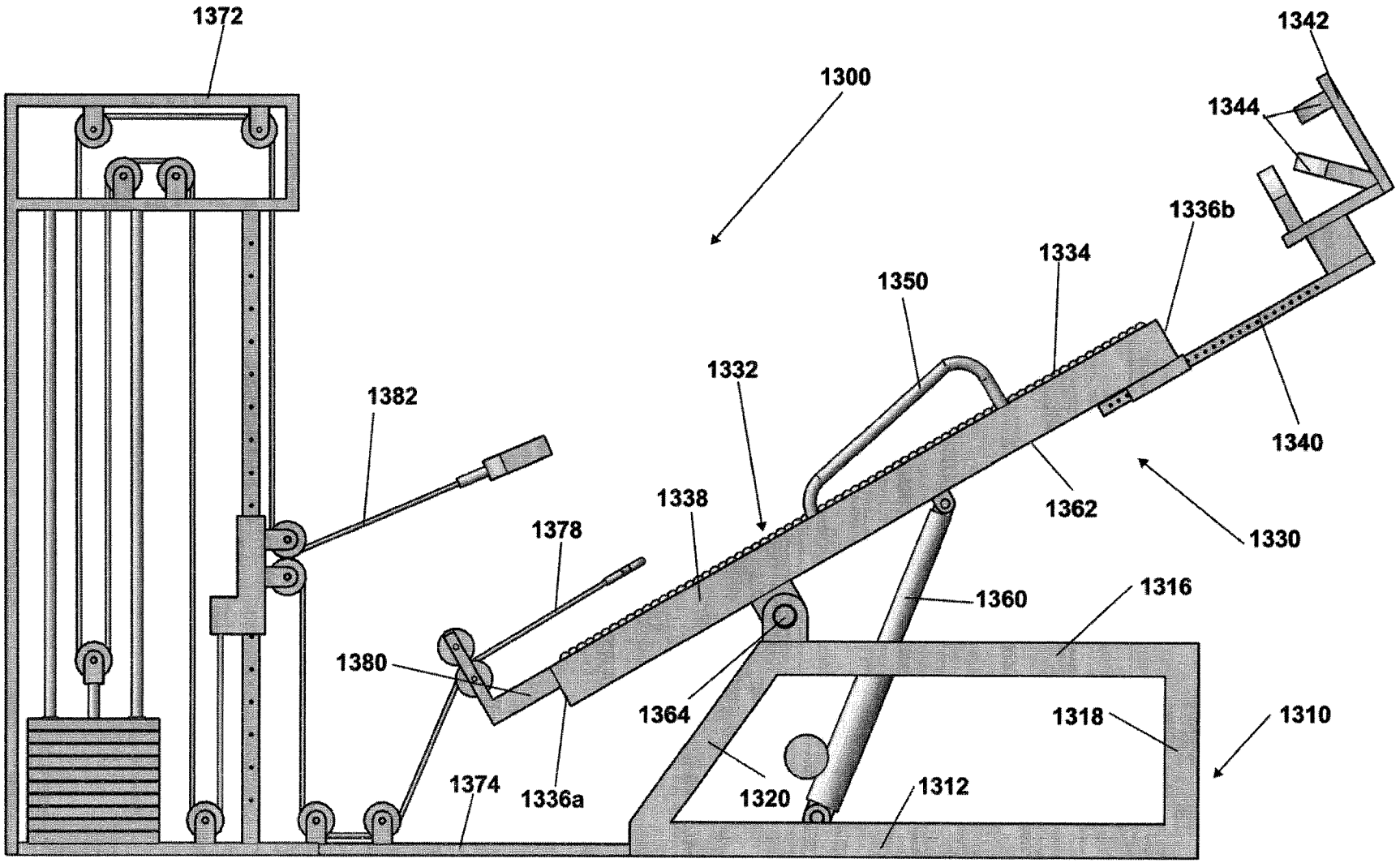

Reference is now made to FIGS. 15A and 15B, which are a perspective view illustration and a side view planar illustration of an inversion massage-surface exercise machine 1300 constructed according to the present invention, in a user-mounting operative orientation, and to FIGS. 16A and 16B, which are a perspective view illustration and a side view planar illustration of the inversion massage-surface exercise machine 1300 in an exercise and spinal decompression operative orientation.

As seen in FIGS. 15A to 16B, inversion massage-surface exercise machine 1300 includes a base-frame 1310 which includes a first generally rectangular frame portion 1312. An additional transverse bar 1315 extends within frame portion 1312. Base-frame 1310 further includes a second, generally rectangular frame portion 1316, such that planes defined by frame portions 1312 and 1316 are generally parallel to one another. Two pairs of bars 1318 and 1320 connect frame portions 1312 and 1316 to one another.

In some embodiments, such as the illustrated embodiment, frame portion 1316 has a smaller foot print than frame portion 1312, such that bars 1318 extend generally perpendicularly between the two frame portions, and bars 1320 extend from the end of frame portion 1312 to the end of the second frame portion 1316 and are angled relative to the planes defined by frame portions 1312 and 1316.

A massage surface assembly 1330 is connected to base-frame 1310 and is movable relative thereto as explained in further detail herein. Massage surface assembly 1330 includes a generally rectangular massage table 1332, defining a massage surface 1334. Massage table 1332 includes first and second longitudinal ends 1336*a* and 1336*b*, and two lateral ends 1338. Massage surface 1334 preferably is a flat low friction surface, for example formed of a plurality of ball transfer units 10 as described hereinabove with reference to FIGS. 6A and 6B.

Extending from longitudinal end 1336*b* of massage table 1332 and moveable relative thereto is a telescopically extending bar 1340 terminating in a footrest 1342, adapted for a user to place his or her feet thereon, as described hereinbelow. Footrest 1342 includes a plurality of anchoring elements 1344, such as anchoring straps, for anchoring the user's feet to footrest 1342.

Telescopically extending bar 1340 is movable relative to massage table 1332, such that the length of bar 1340 extending beyond longitudinal end 1336*b* may be adjusted based on the height of the user, as described in further detail herein. In some embodiments, bar 1340 includes a plurality of bores, adapted to have a pin extending therethrough, thereby to set the extent to which bar 1340 extends beyond end 1336*b*, as known in the art of exercise machines.

A pair of hand rails 1350 are disposed along lateral ends 1338 of massage table 1332.

A connecting mechanism 1360 extends between transverse bar 1315 and a lower surface 1362 of massage table 1332 and facilitates changing of the angle of massage table 1332 relative to the horizon or to the base surface of machine 1300. In some embodiments, the connecting mechanism 1360 comprises a pneumatic mechanism. In some embodiments, the lower surface 1362 of massage table 1332 is further movably connected to one end of frame portion 1316, for example by an axle mechanism 1364. The connecting mechanism 1360 and axle mechanism 1364 facilitate tilting of massage surface assembly 1330 from a user-mounting operative orientation to an exercise and spinal decompression operative orientation. In the user-mounting operative orientation, illustrated in FIGS. 15A and 15B, footrest 1342 is positioned lower than end 1336*a* of massage table 1332. In the exercise and spinal decompression operative orientation, illustrated in FIGS. 16A and 16B, footrest 1342 is positioned higher than end 1336*a* of massage table 1332, and a user laying on massage table 1332 would be inverted with his head being positioned lower than his feet, as described herein with respect to FIG. 18.

A head exercise cable column 1370, and a pair of arm exercise cable columns 1372, as known in the art of exercise machines, are connected to base frame 1310 by a base arrangement 1374 and are at a fixed distance from massage surface assembly 1330. A first roller guiding cable 1378 extends from head exercise cable column 1370 to a bar 1380 extending from end 1336 of massage table 1332 via a plurality of rollers, as is known in the art. A pair of second roller guiding cables 1382 extend from arm exercise cable columns 1372 to the sides of massage table 1332 via a plurality of rollers, as is known in the art. Guiding cable 1378 enables a load to be provided to the user's head, and guiding cables 1382 enable the user to exercise his arms using weights and loads, when disposed on massage surface 1334, as described hereinbelow with reference to FIG. 18.

Figure 17A:
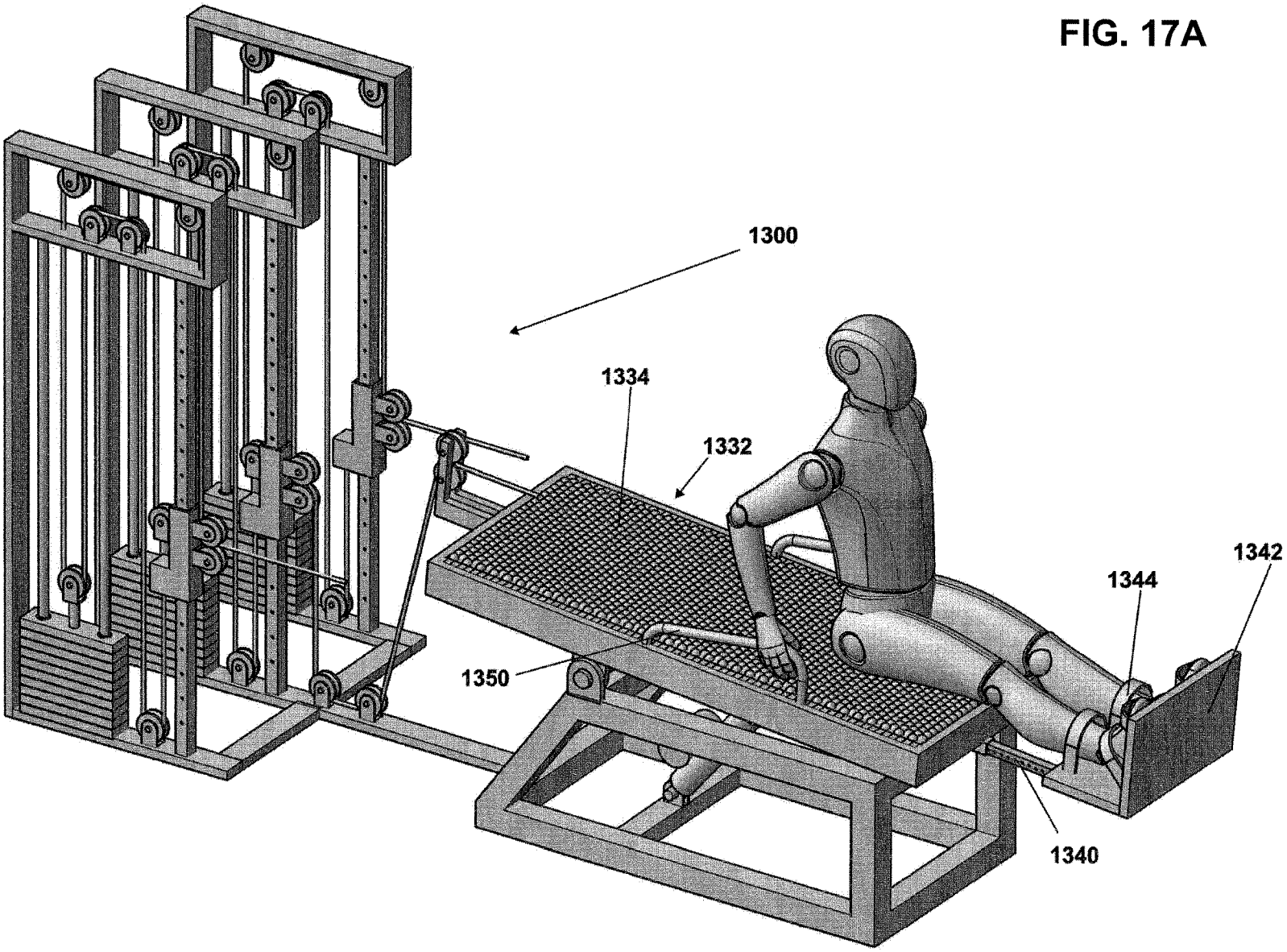
FIGS. 17A and 17B are schematic representations of a user mounting the inversion massage-surface exercise machine of FIGS. 15A and 15B.
Figure 17B:
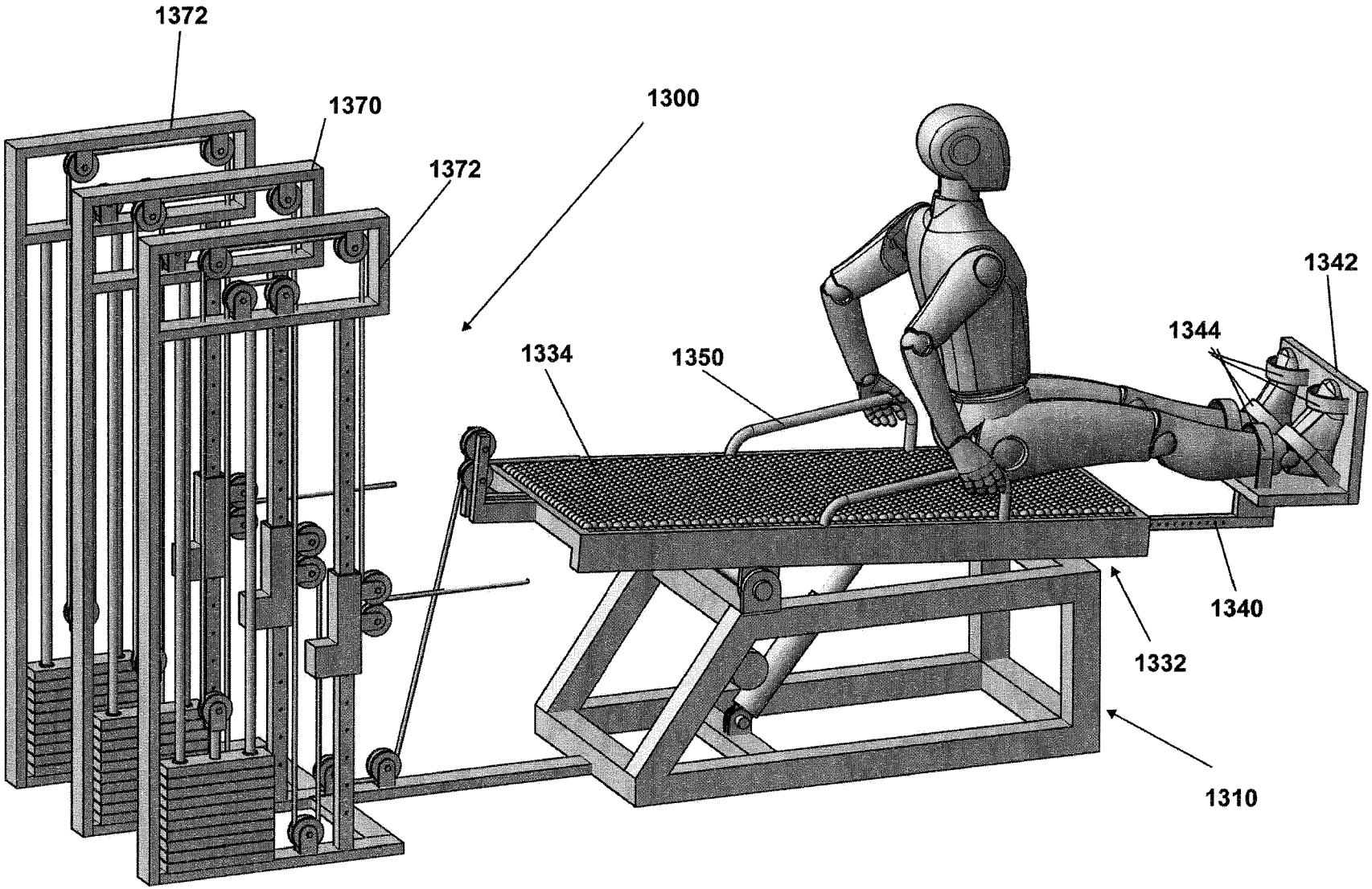

Reference is now made to FIGS. 17A and 17B, which are schematic representations of a user using the inversion massage-surface exercise machine 1300 of FIGS. 15A and 15B. As seen in FIGS. 17A and 17B, the user mounts the machine 1300 when the machine is in the user-mounting operative orientation by sitting onto massage surface 1334 and anchoring his feet to footrest 1342 using anchoring straps 1344. The user may hold onto hand rails 1350 while mounting machine 1300. Once the user's feet are anchored to footrest 1342, the user lies down with his back on massage surface 1334.

Subsequently, the user may use an actuator (not shown), such as a suitable lever associated with connecting assembly 1360 or an electromechanical remote controller, to change the angle of massage surface assembly 1330 such that machine 1300 transitions from the user-mounting operative orientation of FIGS. 15A and 15B to the exercise and spinal decompression operative orientation of FIGS. 16A and 16B.

Figure 18:
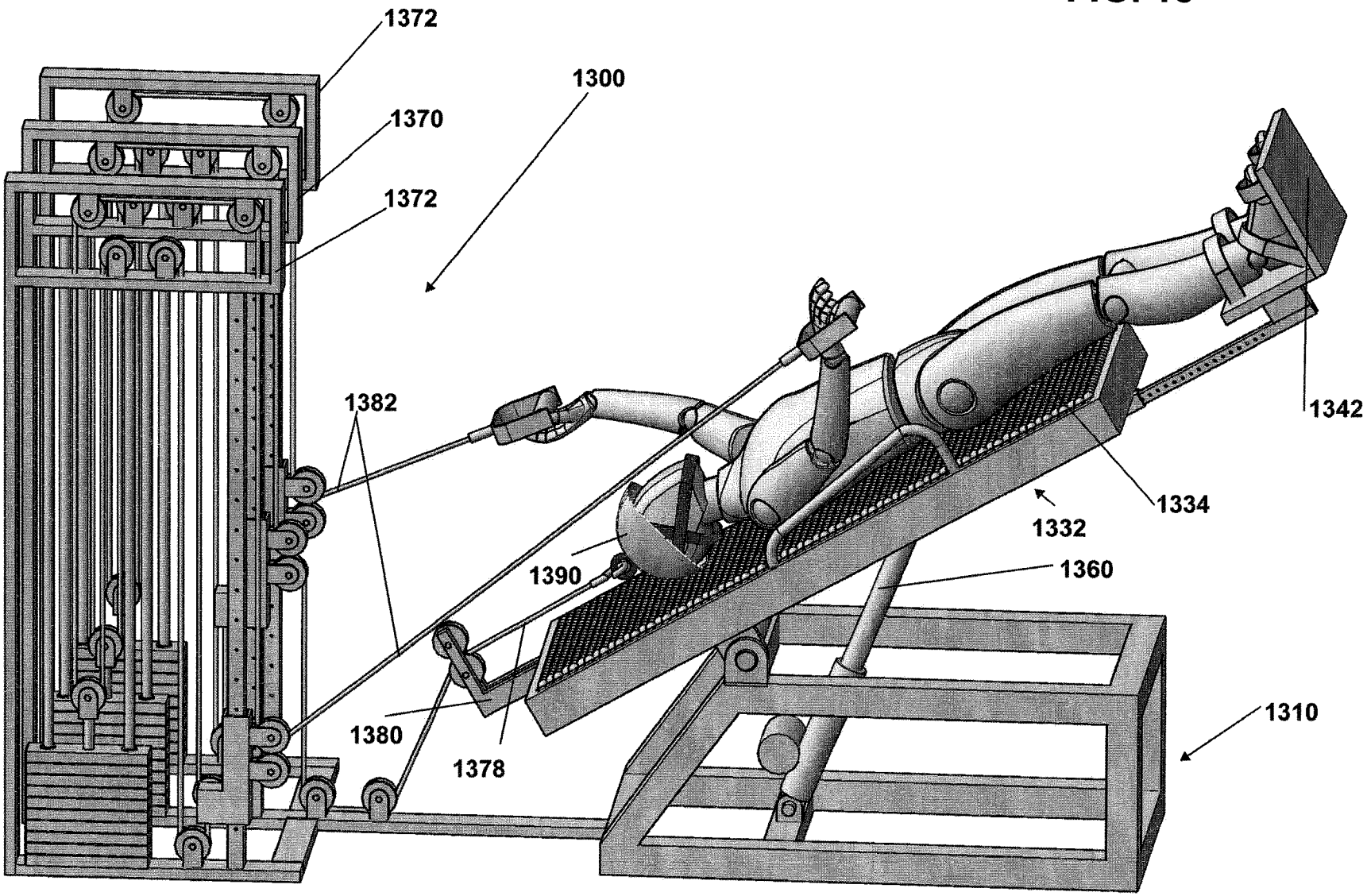
FIG. 18 is a schematic representation of a user using the inversion massage-surface exercise machine of FIGS. 16A to 16B for performing exercises using additional weights.

Reference is now made to FIG. 18, which is a schematic representation of a user using the inversion massage-surface exercise machine of FIGS. 16A and 16B for performing exercises using additional weights.

Once the user lies on massage surface 1334 with his feet in footrest 1342 when the massage surface is in the exercise and spinal decompression operative orientation, the user's body attempts to slip downward, toward the cable columns 1370 and 1372 under gravitational pull. Due to the anchoring of the user's feet to the footrest, and due to the reduced friction of massage surface 1334, the user's body can slide along massage surface 1334 thereby stretching the user's spine and joints.

In some embodiments, the user's head is connected to cable column 1370 via a dedicated helmet 1390 fastened onto the user's head and via cable 1378. The weights in the weight stack of cable column 1370 increase the pulling force on the user's body towards cable column 1370, which pulling force is aligned strictly along the center of the user's body and the spinal line, thus contributing to targeted decompression of all parts of the spine.

In some embodiments, the user may hold one or both of cables 1382 extending from cable columns 1372 to sides of massage table 1332 and carry out exercises using his hands when disposed on massage surface 1334, without compressive loads being applied to the joints and the spinal discs. The manipulation of the weight stacks of cable column 1372 may exercise flexor muscles and/or extensor muscles, depending on the initial position in which the user holds cables 1382. The loads applied by the weight stack of cable columns 1370 and 1372 are typically preset, but the user or by a helper thereof, in accordance with the user's physical ability and exercise plan.

It is a particular feature of machine 1300 that the gravitational pulling power granted by the reduced friction of massage surface 1334 serves to reduce the load on the trained muscle groups when performing physical exercises, to create the opportunity to train these muscles under loads that the person is able to overcome in accordance with his physical condition and exercise plan.

As discussed herein with respect to FIGS. 16A and 16B, the angle of inclination of massage surface 1334 may be adjusted and set by the user. Adjustment of the angle of inclination allows the user to select the degree to which gravitational pull will cause the user to slip along massage surface 1334, and thus the degree of decompression of the body and stretching of the muscles, joints and spine resulting from such slipping. Additionally, the arrangement of the user's body on massage surface 1334 such that the position of the user's head is lower than the position of the user's legs creates vertical decompression combining gravitation pull on the body under the body's own weight, and in the embodiments of FIG. 18 stretching of the body through use of additional loads.

Regardless of the angle of inclination of massage surface 1334, and the loads applied or not applied by cable columns 1370 and 1372, the ball transfer units of massage surface 1334 provide acupressure to parts of the user's body leaning on or in contact with massage surface 1334 during the exercise and contribute to more complete stretching of the muscles, and correspondingly to more significant decompression of the user's spine and joints.

Figure 19A:
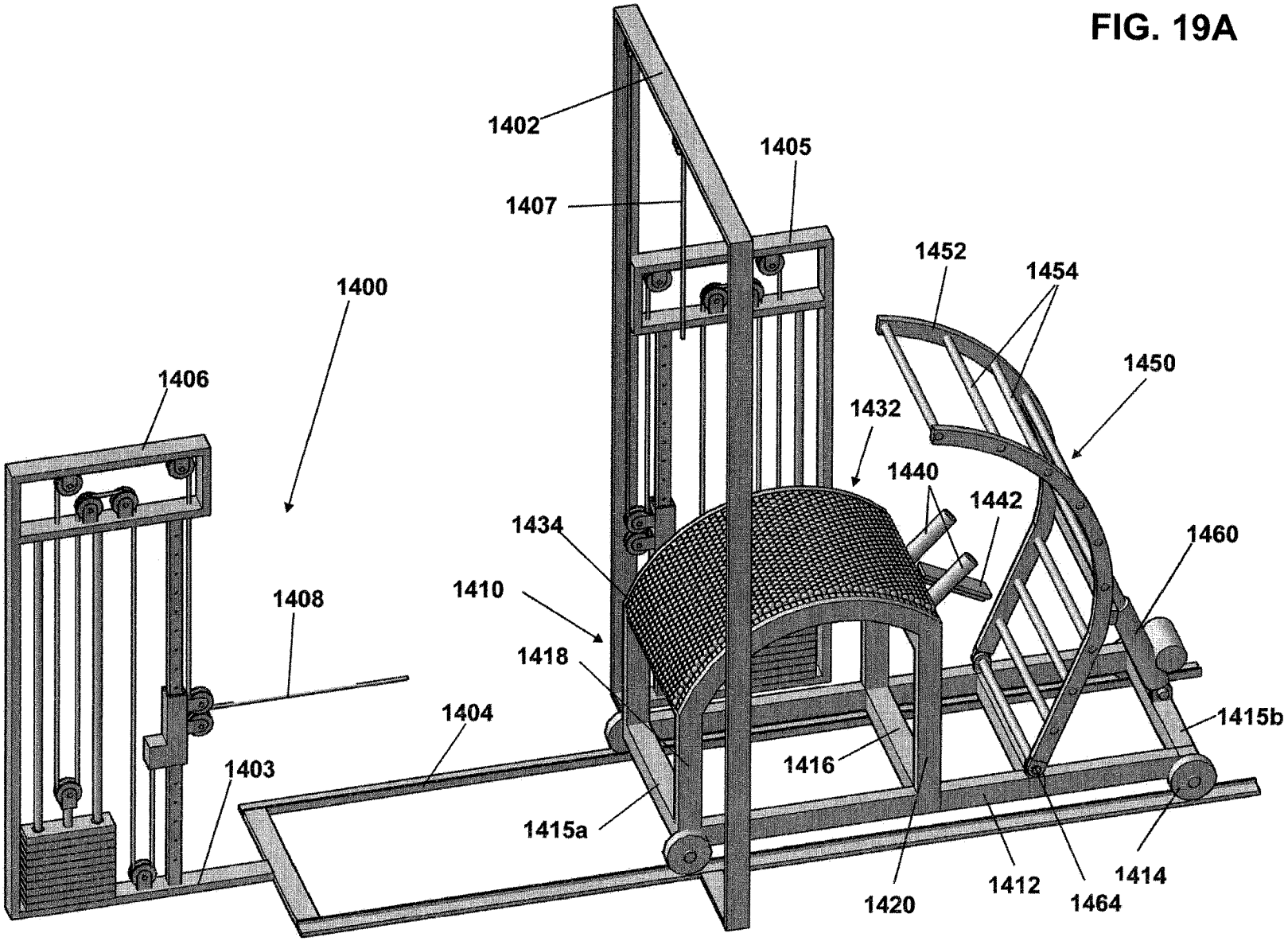
FIGS. 19A, 19B, and 19C are two perspective view illustrations and a side view planar illustration of a barrel massage-surface exercise machine constructed according to the present invention.
Figure 19B:
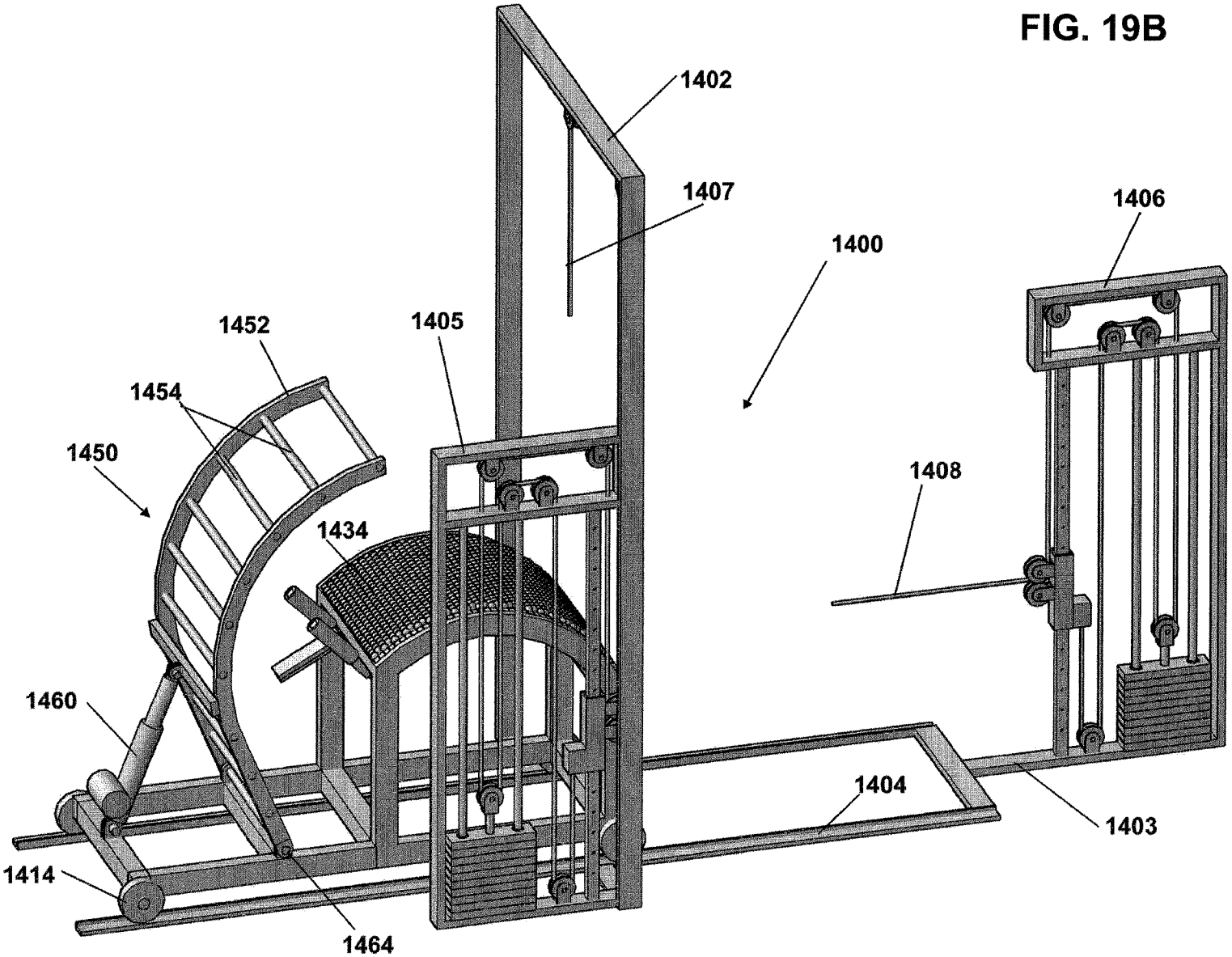
Figure 19C:
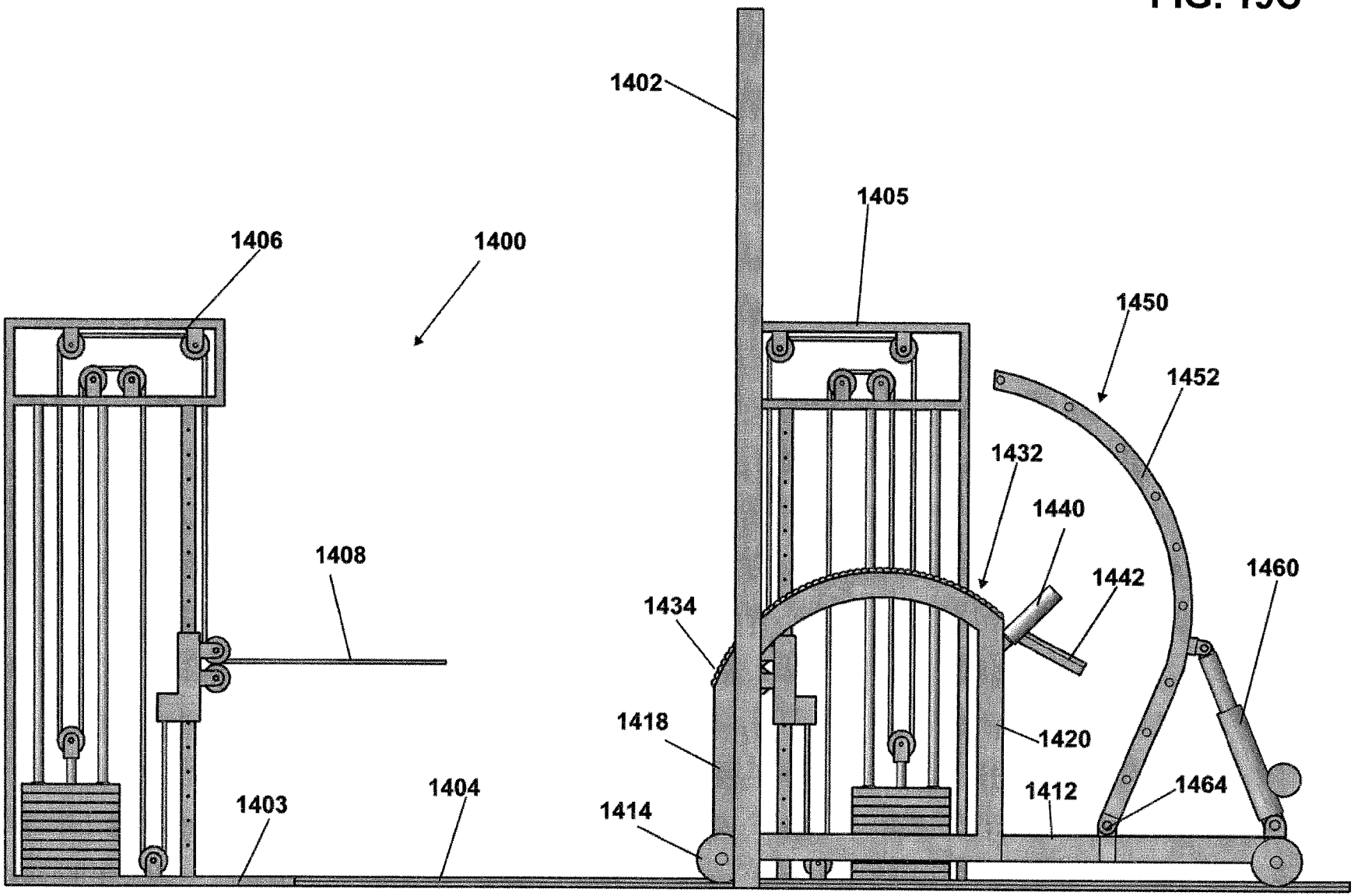

Reference is now made to FIGS. 19A, 19B, and 19C, which are two perspective view illustrations and a side view planar illustration of a barrel massage-surface exercise machine 1400 constructed according to the present invention.

As seen in FIGS. 19A to 19C, barrel massage-surface exercise machine 1400 includes a vertically arranged frame 1402, having connected thereto a pair of guides 1404 extending along a base surface of the machine 1400. Frame 1402 is functionally associated with and is connected to a first exercise cable column 1405, and guides 1404 are connected to a second exercise cable column 1406 via a connector segment 1403. Exercise cable columns 1405 and 1406 may be any suitable exercise cable columns, as known in the art. A first roller guiding cable 1407 extends from first exercise cable column 1405 along part of frame 1402 and downwardly therefrom via a plurality of rollers, as is known in the art. A second roller guiding cable 1408 extends from first exercise cable column 1406 towards frame 1402 via a plurality of rollers, as is known in the art. The guiding cables 1407 and 1408 enables a user to exercise using cable columns 1405 and 1406 when using barrel massage surface exercise machine 1400, as described hereinbelow with reference to FIGS. 20A to 20C.

A base-frame 1410 includes a first generally rectangular frame portion 1412 functionally associated with a plurality of wheels 1414, adapted to be movable along guides 1404. Specifically, frame portion 1412 includes a first end 1415*a* and a second end 1415*b*, the first end 1415*a* being closer to cable column 1406. An additional transverse bar 1416 extends within frame portion 1412, between first end 1415*a* and second end 1415*b*. Base-frame 1410 further includes a first pair of vertical bars 1418 extending upward from edges of end 1415*a*, and a second pair of vertical bars 1420 extending upward from edges of transverse bar 1416, vertical bars 1420. In some embodiments, vertical bars 1420 are longer than vertical bars 1418.

A barrel shaped massage table 1432, defining a curved massage surface 1434 extends between vertical bars 1418 and 1420. Massage surface 1434 preferably is a low friction surface, for example formed of a plurality of ball transfer units 10 as described hereinabove with reference to FIGS. 7A to 7B and 9A to 9B.

A pair of shoulder rests 1440 and a head rest 1442 are removably attached to an end of massage table adjacent vertical bars 1420. In some embodiments, the user may hold shoulder rests 1440 and/or rest his head on head rest 1442 when exercising using machine 1400, as described hereinbelow with respect to FIGS. 20A to 20C.

A rack 1450 having curved sidebars 1452 and a plurality of crossbeams 1454 extending along the curve thereof is connected to frame portion 1412 at a fixed position between second end 1415*b* and transverse bar 1416. In some embodiments, a curvature of rack 1450 is substantially parallel to the curvature of massage table 1432.

A connecting mechanism 1460 extends between second end 1415*b* of frame portion 1412 and rack 1450 and facilitates changing of the angle of rack 1450 relative to massage table 1432. In some embodiments, the connecting mechanism 1460 comprises a pneumatic mechanism. In some embodiments, a lower end of rack 1450 is movable relative to frame portion 1412 also by an axle mechanism 1464. Adjustment of the angular arrangement of rack 1450 enables a user to customize the machine 1400 for their dimensions, for example based on the length of the user's arms.

Figure 20A:
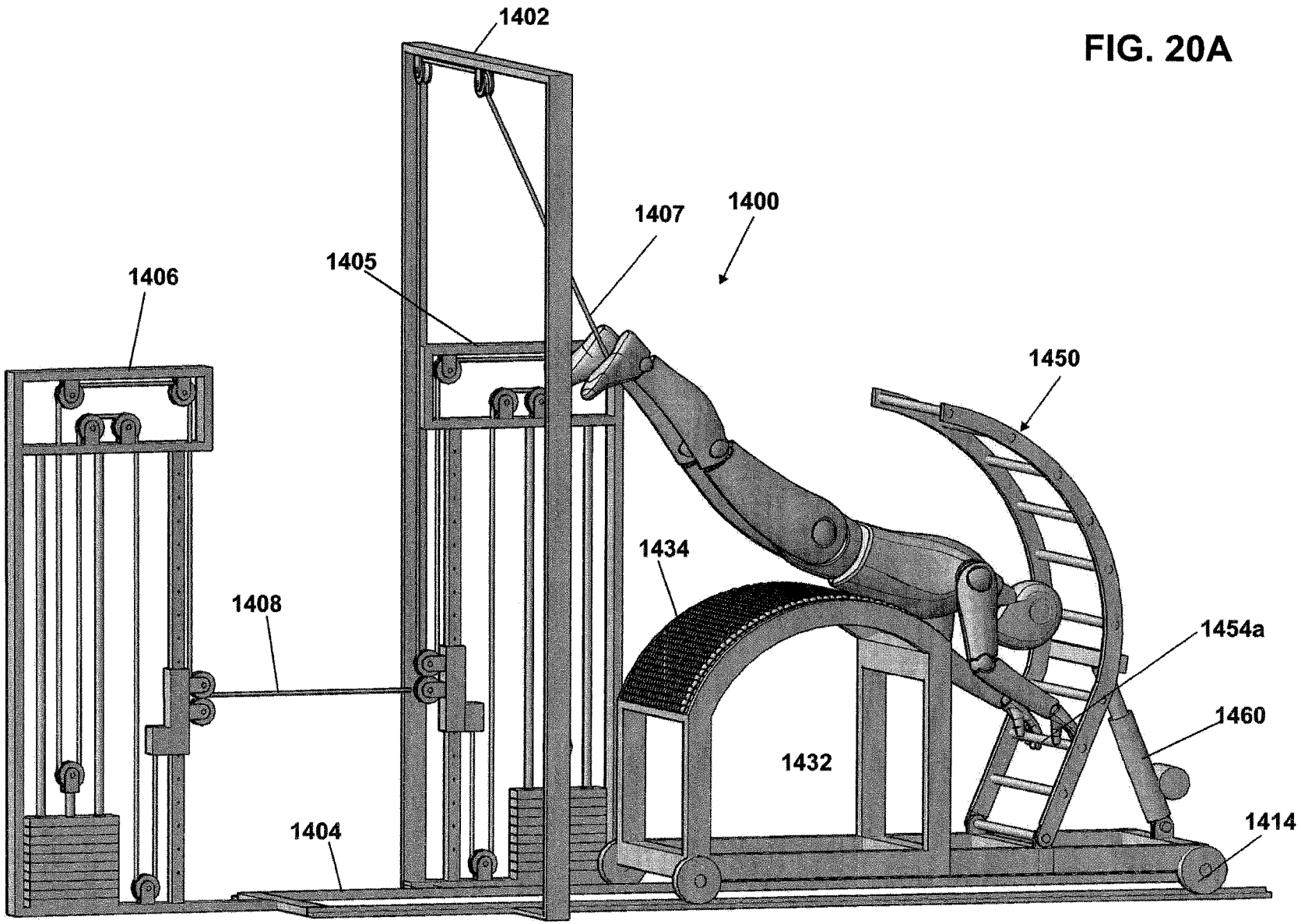
FIGS. 20A, 20B, and 20C are schematic representations of a user using the barrel massage-surface exercise machine of FIGS. 19A to 19C for performing exercises using additional weights.
Figure 20B:
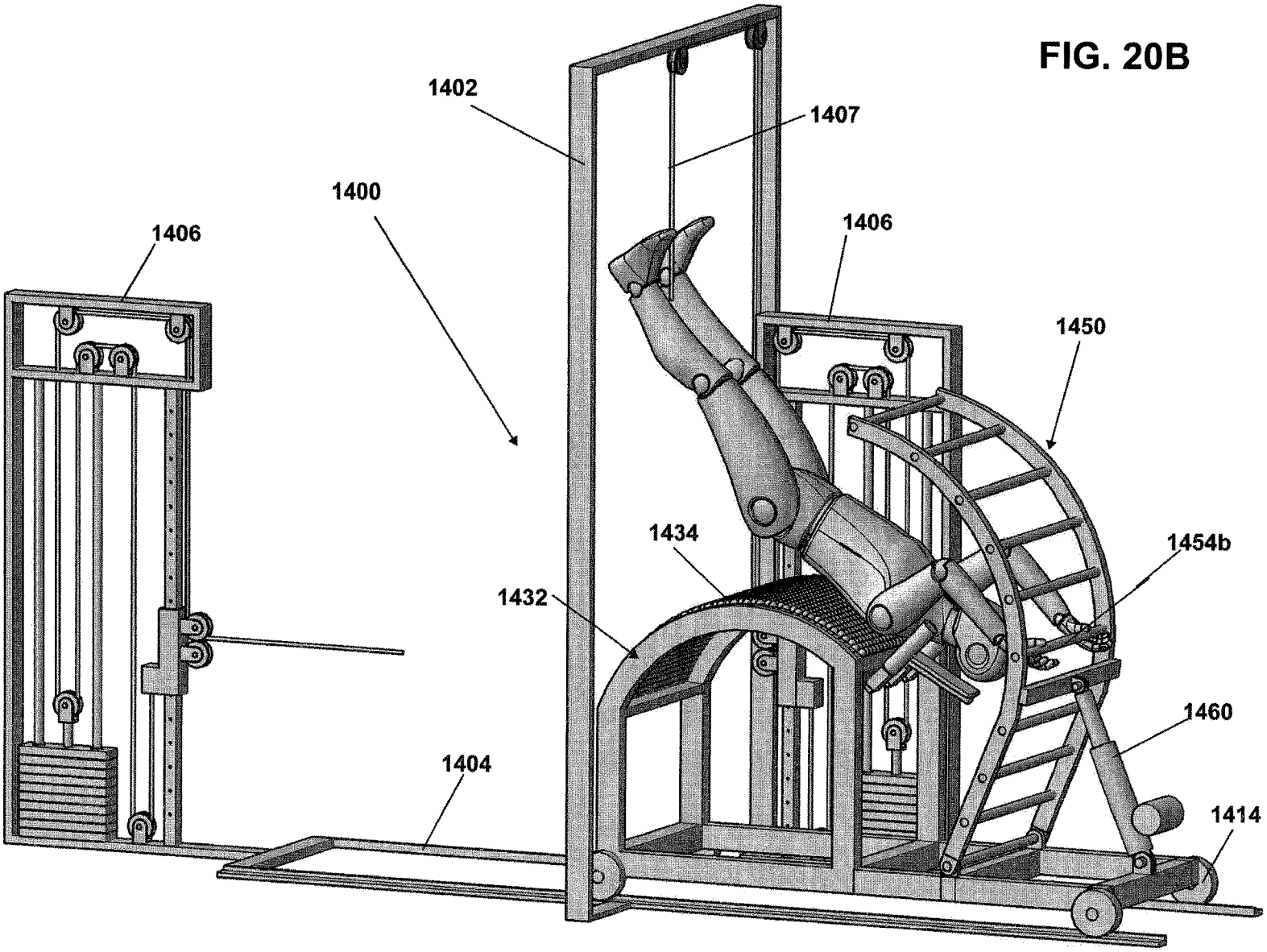
Figure 20C:
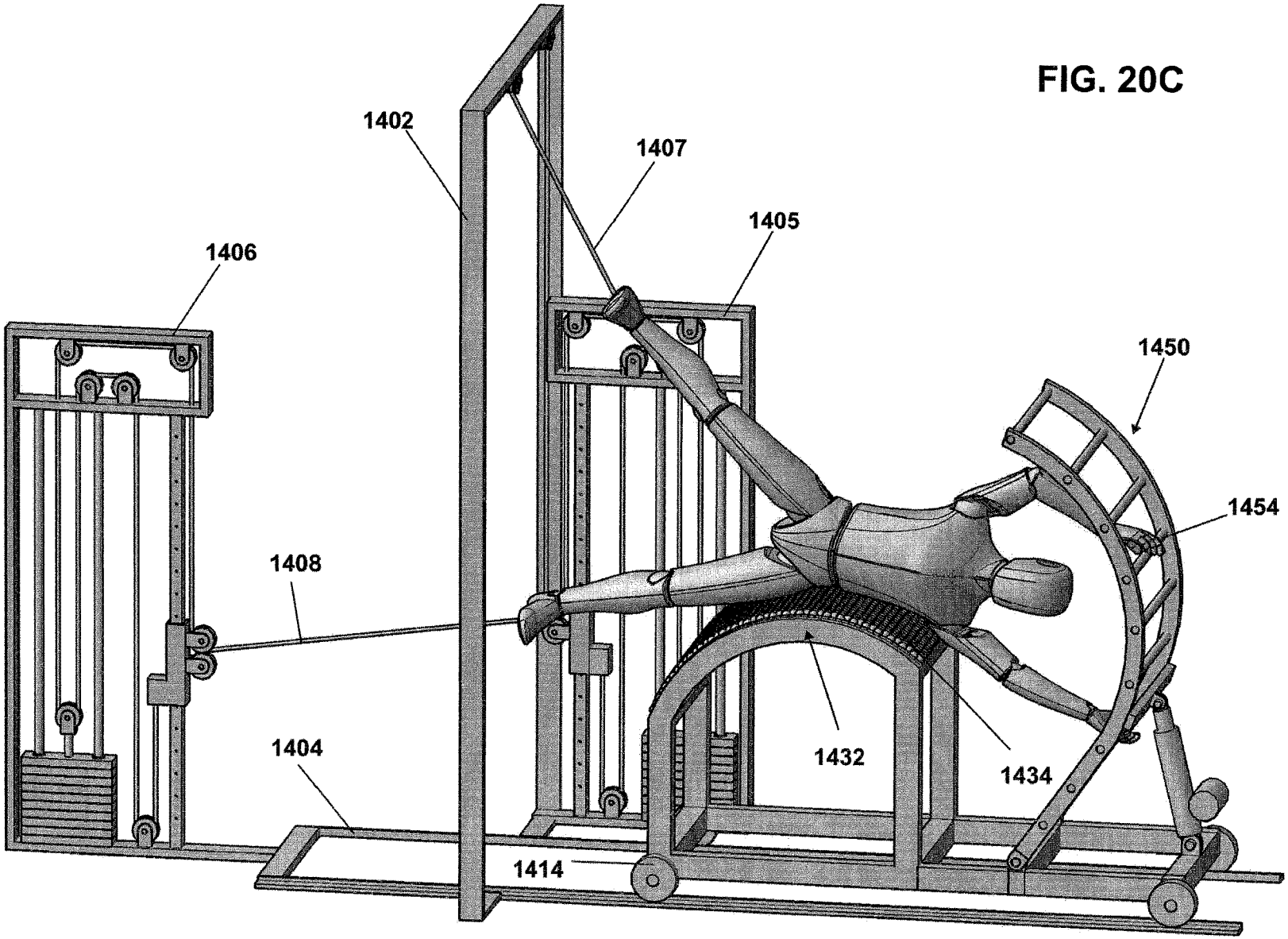

Reference is now made to FIGS. 20A, 20B, and 20C, which are schematic representations of a user using the barrel massage-surface exercise machine 1400 of FIGS. 19A to 19C for performing exercises using additional weights.

When the user wishes to use machine 1400, the user may lie on his stomach, as illustrated in FIG. 20A, on his back, as illustrated in FIG. 20B, or on his side, as illustrated in FIG. 20C. In some embodiments, the user may successively hold crossbeams 1454 to lower himself onto barrel shaped massage table 1432, such that the head of the user is adjacent rack 1450, and the legs of the user are pointed towards cable column 1406. Preferably, the user positions himself such that the peak of barrel shaped massage table 1432 is disposed beneath a part of the user's body that the user intends to bend during a chosen exercise. The maximal degree to which the user may bend his body is limited by the curvature of the massage table 1432.

In some embodiments, the user may use machine 1400 for spinal decompression based on the weight of the user and on gravitational pull. In this mode, the user lies on massage surface 1434 and can flex the body in any desired direction, by raising his legs and/or arms to the maximal point possible based on the user's physical condition and/or to the minimal point possible based on the structure of machine 1400. In this mode, the load on the musculoskeletal apparatus is maximal, and most of the muscle groups of the trunk are involved, while the hip area is involved in an insignificant degree. Decompression of the spine is gravitational and is based on the body weight and the low friction of the massage surface.

In a second mode of operation, illustrated for example in FIGS. 20A and 20B, cable 1407 extending from cable column 1405 via frame 1402 is attached to one or both of the user's legs by dedicated locks connecting the cable to the user's shoe(s) or ankle(s). When the user's hands are anchored by gripping one of crossbeams 1454, the user raises and lowers his legs, manipulating the weights on cable column 1405, to train one or more groups of muscles, while the user's back is flexed.

As discussed hereinabove with respect to FIGS. 19A to 19C, the initial position of the cable 1407, at which the weights of cable column 1405 are stacked and at rest, may be when the legs of the user are raised, thus exercising extensor muscles, or when the legs of the user are lowered onto massage surface 1434, thus exercising flexor muscles. In other embodiments, the cable 1407 and the weight stack of cable column 1405 may be arranged so as to exercise both flexor and extensor muscles. The load applied by the weight stack of cable column 1405 on the user when exercising is typically preset, but the user or by a helper thereof, in accordance with the user's physical ability and exercise plan.

In some embodiments, such as that illustrated in FIG. 20A, the user may exercise using cable column 1405 when his abdomen is disposed on massage surface 1434. In such embodiments, the user may hold onto a crossbeam 1454*a* of rack 1450 disposed lower than his head, and may remove shoulder rests 1440 and head rest 1442 from the massage table 1432.

In other embodiments, such as that illustrated in FIG. 20B, the user may exercise using cable column 1405 when his back is disposed on massage surface 1434. In such embodiments, the user may hold onto a crossbeam 1454*b* of rack 1450 disposed at the height of the user's head or slightly higher than the user's head, and may rest his head on head rest 1442 and shoulders on the shoulder rest 1440.

It is a particular feature of machine 1400, when used as illustrated in FIGS. 20A and 20B, that it enables training of all surface and deep muscle groups of the body, from the shoulder girdle up to the hip zone, including muscles of the corset which support the spine. By choosing appropriate weights and positioning the user's body on the massage surface 1434 such that the peak of barrel shaped massage table 1432 is disposed beneath a part of the user's body that the user intends to bend during a chosen exercise, exercise on machine 1400 may enable flexion of the body to the extent that is comfortable to any person of any physical condition.

In a third mode of operation, illustrated in FIG. 20C, the user lies on massage surface 1434 on his side, such that cable 1407 extending from cable column 1405 via frame 1402 is attached to one of the user's legs and cable 1408 extending from cable column 1406 is attached to the other of the user's legs, by dedicated locks connecting the cable to the user's shoes or ankles. The user's hands hold onto one or two of crossbeams 1454 of rack 1450, as illustrated. In this position, the user raises and lowers his upper leg pulling on the weight stack of cable column 1405 via cable 1407, while the other leg remains stationary and is under a horizontal pulling force from cable column 1406.

In this mode of operation, emphasis is placed on the development of the hip and lumbar muscles, and the body bend is fixed due to the position of the hands that grip the crossbeams and because of the horizontal pulling force applied by cable column 1406. Additionally, in this mode, a hardware method of decompression (i.e. using tools and weights other than the user's body weight) of the spine and joints is used, and gravitational pull on the user's body weight is neutralized, due to the horizontal and lower horizontal pulling forces.

As discussed hereinabove, and as seen from comparison of FIGS. 20A, 20B, and 20C, base frame 1410 together with massage table 1432 are movable relative to frame 1402 and cable 1407, by rolling of wheels 1414 along guides 1404. By changing the relative position of the frame 1402 and the massage table 1432, and the distance therebetween, the direction of thrust during the exercises may be changed. As a result, the point of maximum inflection of the spine when lifting the legs may be adjusted to be in the hip zone, lower, middle, or upper spine regions. Thus, by setting the location of massage table 1432, it is possible to influence directly different groups of muscles so as to restore and develop the flexibility of the spine in associated regions of the spine, including in the hip area.

Regardless of the relative locations of frame 1402 and massage table 1432, and the load applied or not applied by cable column 1405 and/or 1406, the ball transfer units of massage surface 1434 provide acupressure to parts of the user's body leaning on or in contact with massage surface 1434 during the exercise and contribute to more complete stretching of the muscles, and correspondingly to more significant decompression of the user's spine and joints.

It will be appreciated by those skilled in the art that exercise machines 1200, 1300, and 1400 described herein are suitable for use in centers for therapeutic exercise, fitness centers, rehabilitation centers, medical offices, sports centers, and army training centers, among others.

It will further be appreciated by those skilled in the art that exercise machines 1200, 1300, and 1400 may provide multiple benefits to a user thereof, including, but not limited to:

- Slowing down of body aging and rejuvenating the body;
- Enabling rehabilitation and development of the musculo skeletal system for the elderly and for users who have problems with the spine and joints;
- Preventing age-related decrease in growth due to compression of the spine and joints;
- Aligning the user's posture and improving or eliminating a stooped posture;
- Assisting in loss of excess weight;
- Enabling fine-tuning of the decompression effects;
- Eliminating stagnation in muscles and internal organs;
- Relieving muscle pain;
- Restoring the tonus of the musculoskeletal system;
- Restoring the mobility of joints and the flexibility of the spine;
- Restoring the support provided by the muscular corset to the spine;
- Restoring muscle mass and muscle strength;
- Restoring impaired posture;
- Reducing pain in the back and in the joints;
- Decelerating physical deterioration of joints;
- Facilitating comprehensive recovery of mobility of the musculo skeletal system, spine and joints;
- Removing muscular spasms from the neck and back of the user; and
- Providing acupressure massage of muscle spasms.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A reduced friction massage and exercise device, the device comprising:

a base frame;

at least one anchoring arrangement for anchoring a first body part of the user;

a reduced friction surface mounted onto said base frame, said reduced friction surface including a plurality of ball transfer unit blocks, each ball transfer unit block including:

a bracket; and a set of multiple ball transfer units each including a housing element housing a motion transfer ball, said multiple ball transfer units being mounted onto said bracket, such that in each said ball transfer unit block, each ball transfer unit engages ball transfer units of said set which are adjacent thereto, wherein each pair of adjacent ones of said plurality of ball transfer unit blocks are longitudinally offset from each other such that for a majority of said plurality of ball transfer units, each ball transfer unit in a specific ball transfer unit block engages two other ball transfer units forming part of said specific ball transfer unit block, and four ball transfer units forming part of two other said ball transfer unit blocks; and at least one cable column including a weight stack;

wherein each of said motion transfer balls of each said ball transfer unit is adapted for omnidirectional rotation relative to a corresponding said housing element and independently of other said motion transfer balls, wherein said reduced friction surface is adapted to have a second body part of the user placed thereon during performing of a physical activity.

2. The device of claim 1, wherein said anchoring arrangement is movable relative to said reduced friction surface, so as to adjust a distance between said anchoring arrangement and said reduced friction surface to be suited to dimensions of the user.

3. The device of claim 1, wherein said at least one cable column includes at least one guiding cable functionally associated with said weight stack, said at least one guiding cable being adapted to be connected to a body part of the user when the user performs the physical activity so as to apply additional load to the second body part during the physical activity.

4. The device of claim 1, wherein:

said base frame, said at least one anchoring arrangement, and said reduced friction surface are moveable relative to said at least one cable column; or said at least one anchoring arrangement and said reduced friction surface are movable relative to said base frame, so as to change the angular inclination of said reduced friction surface relative to the horizon.

5. The device of claim 4, wherein said at least one anchoring arrangement is for anchoring hands of the user, and wherein said reduced friction surface is adapted to be inclined relative to said base frame or convex along a longitudinal direction thereof, such that a head of the user is disposed higher than legs of the user during the physical activity.

6. The device of claim 4, wherein said at least one anchoring arrangement is for anchoring legs of the user, and wherein said reduced friction surface is planar and is adapted to be inclined relative to said base frame, such that a head of the user is disposed lower than legs of the user during the physical activity.

7. The device of claim 1, wherein said reduced friction surface is barrel shaped and is in a fixed position relative to said base frame.

8. The device of claim 7, wherein said at least one cable column comprises a first cable column and a second cable column, the first and second cable columns each having a guiding cable enabling the user to manipulate said weight stacks of said first and second cable columns, said guiding cables of said first and second cable column being arranged at an angle relative to each other when the user is not engaging said guiding cables.

9. The device of claim 7, wherein said at least one anchoring element comprises an anchoring rack including a plurality of crossbeams, said anchoring rack having a curved profile, wherein said anchoring rack at least partially overlaps said said reduced friction surface.

10. A method of exercising using the reduced friction device of claim 1, the method comprising:

disposing the second body part of the user on said reduced friction surface;

engaging said at least one anchoring element at least with the first body part of the user; and carrying out said physical activity while said second body part of the user is disposed on said reduced friction surface.

11. The method of claim 10, wherein said carrying out a physical activity includes allowing said second body part of the user to be pulled along said reduced friction surface under gravitational pull, so as to stretch muscles of said second body part of the user and to decompress bones and joints associated with said muscles.

12. The method of claim 10, wherein said carrying out a physical activity includes carrying out said physical activity using said second body part of the user or a third body part of the user adjacent to the second body part of the user, and the user's own body weight.

13. The method of claim 10, further comprising:

setting said weight stack of said at least one cable column to a weight suitable for exercise by said user; and attaching a guiding cable of said at least one cable column to said second body part of user or to a third body part of the user adjacent said second body part of the user, and wherein said carrying out a physical activity includes carrying out said physical activity using said second body part of the user or said third body part of the user using load applied by said weight stack.

14. The method of claim 13, wherein said attaching a guiding cable comprises attaching a first guiding cable of a first of said at least one cable column to the second body part of the user and attaching a second guiding cable of a second of said at least one cable column to the third body part of the user, wherein said carrying out physical activity includes carrying out physical activity using said third body part of the user using the load applied by said weight stack of said second cable column, and wherein said weight stack of said first cable column is used to anchor said second body portion of the user.

15. The method of claim 10, further comprising, prior to said disposing said second body part on said reduced friction surface, adjusting a position of said base frame and said reduced friction surface relative to said weight stack.

16. The method of claim 10, further comprising adjusting an angular inclination of said reduced friction surface relative to said base frame.

17. The method of claim 10, further comprising, prior to said anchoring, adjusting a distance between said at least one anchoring element and said reduced friction surface to be suited to dimensions of the user.

18. A reduced friction massage and exercise device, the device comprising:

a base frame;

at least one anchoring arrangement for anchoring a first body part of the user;

a reduced friction surface mounted onto said base frame, said reduced friction surface including a plurality of ball transfer units each including a housing element housing a motion transfer ball, said plurality of ball transfers units arranged such that a majority of said plurality of ball transfer units engages six other ball transfer units disposed there-around, wherein each of said motion transfer balls of each said ball transfer unit is adapted for omnidirectional rotation relative to a corresponding said housing element and independently of other said motion transfer balls; and a cable column including a weight stack connected to a helmet adapted to be fastened to a head of the user;

wherein said reduced friction surface is adapted to have a torso of the user placed thereon, while reducing friction between the torso of the user part and the surface, such that a pulling force applied by the weight stack to the user's body, via the helmet, is aligned strictly along the center of the user's body and the spinal line, thereby contributing to decompression of all parts of the spine.

* * * * *